US009927773B2

(12) United States Patent
Di Domenico et al.

(10) Patent No.: US 9,927,773 B2
(45) Date of Patent: Mar. 27, 2018

(54) NATURAL ESCAPEMENT

(71) Applicant: The Swatch Group Research and Development Ltd, Marin (CH)

(72) Inventors: Gianni Di Domenico, Neuchatel (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 46 days.

(21) Appl. No.: 15/028,599

(22) PCT Filed: Dec. 9, 2014

(86) PCT No.: PCT/EP2014/077039
§ 371 (c)(1),
(2) Date: Apr. 11, 2016

(87) PCT Pub. No.: WO2015/096979
PCT Pub. Date: Jul. 2, 2015

(65) Prior Publication Data

US 2016/0266546 A1 Sep. 15, 2016

(30) Foreign Application Priority Data

Dec. 23, 2013 (CH) ..... 2140/13
Dec. 23, 2013 (EP) ..... 13199427
(Continued)

(51) Int. Cl.
*G04B 15/14* (2006.01)
*G04C 3/04* (2006.01)
(Continued)

(52) U.S. Cl.
CPC ..... *G04B 15/14* (2013.01); *G04B 15/00* (2013.01); *G04C 3/04* (2013.01); *G04C 3/06* (2013.01);
(Continued)

(58) Field of Classification Search
CPC . G04C 3/04; G04C 3/06; G04C 3/066; G04C 3/067; G04C 5/00; G04C 5/005
See application file for complete search history.

(56) References Cited

U.S. PATENT DOCUMENTS 2,554,523 A * 5/1951 Clifford ..... G04C 5/005 368/126
2,690,646 A 10/1954 Clifford
(Continued)

FOREIGN PATENT DOCUMENTS

| | | | | |
|---|---|---|---|---|
| CH | 339 582 | | 6/1959 | |
| DE | 1 935 486 U | | 3/1966 | |
| JP | 52040366 A | * | 3/1977 | ..... G04C 5/00 |

OTHER PUBLICATIONS

International Search Report dated Oct. 14, 2015, in PCT/EP2014/077039, filed Dec. 9, 2014.

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

An escapement mechanism including a stop member between a resonator and two escape wheel sets each subjected to a torque, and each including a magnetized or ferromagnetic track over a period. The stop member includes at least one magnetized or ferromagnetic pole shoe, transversely movable with respect to travel of a surface of the track. The pole shoe or the track creates a magnetic field between the pole shoe and the surface, and the pole shoe is confronted by a magnetic field barrier on the track just before each transverse motion of the stop member actuated by the period action of the resonator. The escape wheel sets are each arranged to cooperate alternately with the stop member, and are connected to each other by a direct kinematic connection.

21 Claims, 11 Drawing Sheets

(30) Foreign Application Priority Data

| | | |
|---|---|---|
| Jul. 11, 2014 | (CH) | 1057/14 |
| Jul. 11, 2014 | (EP) | 14176816 |
| Sep. 19, 2014 | (CH) | 1416/14 |
| Sep. 19, 2014 | (EP) | 14185638 |
| Sep. 24, 2014 | (CH) | 1444/14 |
| Sep. 24, 2014 | (EP) | 14186261 |
| Sep. 25, 2014 | (EP) | 14186297 |

(51) Int. Cl.

| | |
|---|---|
| ***G04C 5/00*** | (2006.01) |
| ***G04C 3/06*** | (2006.01) |
| ***G04B 15/00*** | (2006.01) |

(52) U.S. Cl.

CPC ..... *G04C 3/066* (2013.01); *G04C 3/067* (2013.01); *G04C 5/00* (2013.01); *G04C 5/005* (2013.01)

(56) References Cited

U.S. PATENT DOCUMENTS

| | | | | | |
|---|---|---|---|---|---|
| 2,946,183 | A | | 7/1960 | Clifford | |
| 3,132,522 | A | * | 5/1964 | Goldfarb | G04C 5/005 310/15 |
| 3,183,426 | A | | 5/1965 | Haydon | |
| 3,211,012 | A | * | 10/1965 | Murai | G04B 15/00 968/95 |
| 3,518,464 | A | | 6/1970 | Kawakami et al. | |
| 3,609,958 | A | * | 10/1971 | Bertsch | G04C 5/005 368/128 |
| 3,690,191 | A | * | 9/1972 | Hans Ott | F16H 31/00 368/128 |
| 4,793,199 | A | * | 12/1988 | Sodeikat | H02K 7/065 74/141.5 |
| 6,301,981 | B1 | * | 10/2001 | Oechslin | G04B 15/06 368/127 |
| 2008/0259737 | A1 | * | 10/2008 | Cabezas Jurin | G04B 15/06 368/127 |
| 2013/0279302 | A1 | * | 10/2013 | Vardi | G04C 5/005 368/126 |

* cited by examiner

NATURAL ESCAPEMENT

This is a National Phase Application in the United States of International Patent Application PCT/EP2014/077039 filed Dec. 9, 2014, the entire disclosure of which is hereby incorporated herein by reference.

FIELD OF THE INVENTION

The invention concerns a timepiece escapement mechanism including a stop member between, on the one hand, a resonator and, on the other hand, two escape wheel sets each subjected to a torque.

The invention also concerns a timepiece movement including at least one such escapement mechanism.

The invention also concerns a timepiece including at least one such movement and/or including at least one such escapement mechanism.

The invention concerns the field of timepiece mechanisms for the transmission of movement, and more specifically the field of escapement mechanisms.

BACKGROUND OF THE INVENTION

The Swiss lever escapement is a very widely used device which forms part of the regulating member of mechanical watches. This mechanism makes it possible to simultaneously maintain the motion of a sprung balance resonator and to synchronise the rotation of the drive train with the resonator.

In order to fulfil these functions, the escape wheel interacts with the pallet fork by means of mechanical contact forces, and the Swiss lever escapement uses this mechanical contact between the escape wheel and the Swiss lever to fulfil a first function of transmitting energy from the escape wheel to the sprung balance on the one hand, and to fulfil on the other hand a second function which consists of releasing and locking the escape wheel in jerks so that it advances by one step at every vibration of the balance.

The mechanical contacts required to accomplish these first and second functions impair the efficiency, the isochronism, the power reserve and the working life of the watch.

Different studies have proposed synchronising the rotation of the drive wheel with a mechanical resonator by using a contactless force, such as "Clifford" type escapements. All of these systems use an interaction force of magnetic origin that allows for the transfer of energy from the drive wheel to the resonator at the rate imposed by the natural frequency of the resonator. However, they all suffer from the same drawback of failing to fulfil the second function of releasing and locking the escape wheel in jerks in a reliable manner. More specifically, following a shock, the wheel may be desynchronized from the mechanical resonator, and as a result the regulating functions are no longer ensured.

U.S. Pat. No. 3,518,464 in the name of KAWAKAMI TSUNETA describes an electromagnetic mechanism for driving a wheel by a resonator. This Patent mentions that the use of a magnetic drive mechanism as an escapement has an unfavourable effect on frequency. This mechanism includes a vibrating strip, but no stop member, and certainly no multi-stable stop member. During rotation of the wheel and in a fixed position of the resonator, the force between the wheel and the resonator varies progressively between a minimum (negative) and a maximum (positive) value over an angular period.

DE Utility Model No. 1935486U in the name of JUNG-HANS describes a drive mechanism with magnetic detents.

This mechanism also includes a vibrating strip, but no stop member, and certainly no multi-stable stop member. This mechanism includes ramps and barriers which make use of combined and simultaneous movements of the wheel and the resonator.

U.S. Pat. No. 3,183,426A in the name of HAYDON ARTHUR describes an entirely magnetic escapement including a magnetic escape wheel, in which the energy varies continuously and progressively between minimum and maximum when the wheel turns through one half-period and then the energy returns to a minimum value over the following half-period. In other words, the magnetic force on the wheel varies progressively between a minimum (negative) and maximum (positive) value over an angular period.

SUMMARY OF THE INVENTION

The present invention proposes to replace the mechanical contact force between the pallets and the escape wheel with a contactless force of magnetic or electrostatic origin, with an arrangement which reliably and safely ensures the second function of releasing and locking the escape wheel in jerks.

To this end, the invention concerns an escapement mechanism for a timepiece including a stop member between, on the one hand, a resonator and, on the other hand, two escape wheel sets each subjected to a torque, characterized in that each said escape wheel set includes at least one magnetized or ferromagnetic, or respectively, electrically charged or electrostatically conductive track with a period of travel over which its magnetic, or respectively, electrostatic characteristics are repeated, said stop member including at least one magnetized or ferromagnetic, or respectively, electrically charged or electrostatically conductive pole shoe, said pole shoe being movable in a transverse direction relative to the direction of travel of at least one element of a surface of said track, and at least said pole shoe or said track creating a magnetic or electrostatic field in an air-gap between said at least one pole shoe and said at least one surface, and further characterized in that said pole shoe is confronted with a magnetic or electrostatic field barrier on said track just before each transverse motion of said stop member actuated by the periodic action of said resonator, and characterized in that said first escape wheel set subjected to a first torque and said second escape wheel set subjected to a second torque are each arranged to be capable of cooperating alternately with said stop member, and in that said first escape wheel and said second escape wheel pivot about distinct axes and are connected to each other by a direct kinematic connection.

The invention also concerns a timepiece movement including at least one such escapement mechanism.

The invention also concerns a timepiece including at least one such movement and/or including at least one such escapement mechanism.

BRIEF DESCRIPTION OF THE DRAWINGS

Other features and advantages of the invention will appear upon reading the following detailed description, with reference to the annexed drawings, in which:

FIG. 1 shows a simplified version with two internal and external tracks.

FIG. 7 shows a magnetized structure of variable thickness or intensity arranged on an escape wheel, in interaction with a magnetic field created by a magnetic circuit integral with a pallet fork, the interaction being either repulsive or attractive.

FIG. 8 shows a ferromagnetic structure of variable thickness on an escape wheel track, creating a variable air-gap in interaction with the magnetic field created by a magnetic circuit integral with a pallet fork.

FIG. 9 shows an escape wheel with two discs formed of magnetized structures of variable thickness or intensity arranged on two surfaces of an escape wheel in interaction with the magnetic field created by a magnet integral with a pallet fork, which is surrounded by the two surfaces, the interaction may be either repulsive or attractive.

FIG. 10 shows a structure that is mechanically similar to FIG. 9, with, on the two opposite surfaces of the escape wheel, ferromagnetic structures of variable thickness creating a variable air-gap in interaction with a magnetic field created by a magnet integral with the pallet fork.

FIG. 11: point P1 (and equivalent to point P5 offset by a whole period), FIG. 12: point P2, FIG. 13: point P3, FIG. 14: point P4.

FIGS. 29 and 30 show schematic perspective views of the same mechanism comprising a resonator, formed here by a conventional sprung balance assembly, which cooperates with a radial stop member, which cooperates alternately with one or other of two escape wheel sets, which are connected by gearing, and which include a plurality of magnetic paths here, forming ramps and barriers, to cooperate with a pole shoe of the stop member, FIG. 30 being shown without the toothed wheels comprised in these wheel sets.

FIGS. 31 to 34 show plan views of the kinematics of the alternating operation of the stop member between these two escape wheels.

DETAILED DESCRIPTION OF PREFERRED EMBODIMENTS

Figure 1:
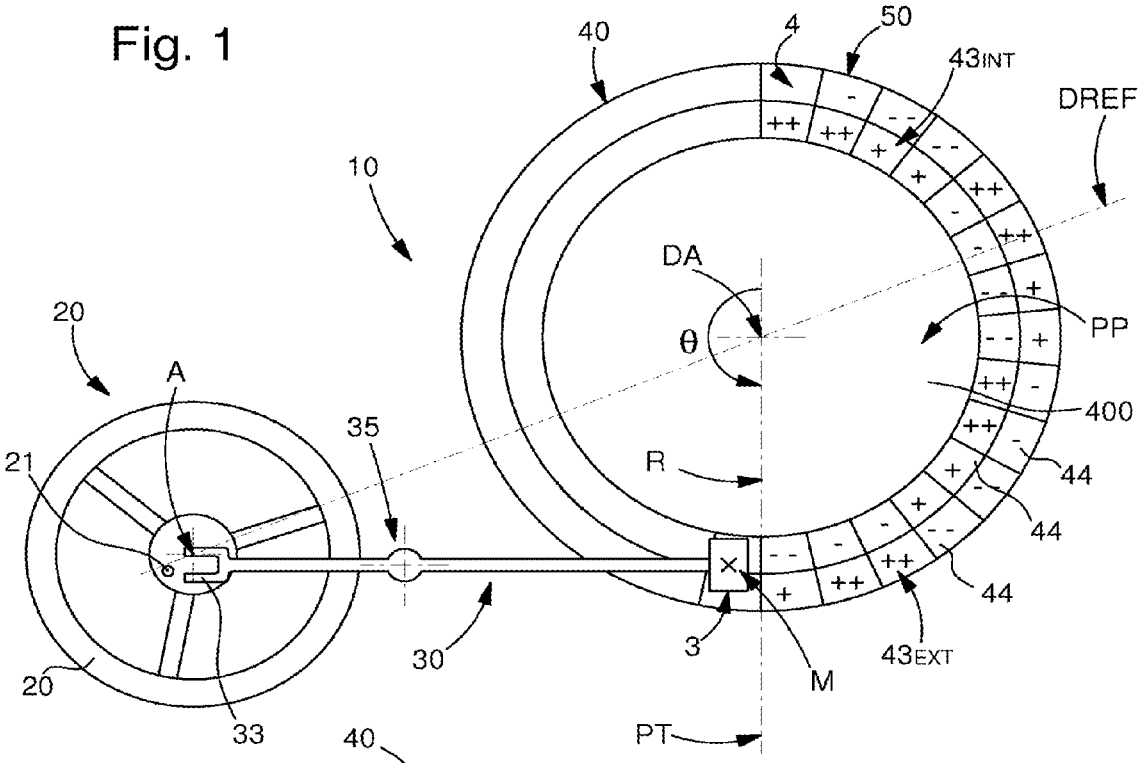
FIG. 1 shows a schematic view of a first embodiment of an escapement mechanism according to the invention including a stop member in the form of a pallet fork-lever with a single magnetic pole shoe, on a pallet lever, and which cooperates with an escape wheel which is magnetized with several secondary concentric tracks, each of these tracks including a series of magnetized areas of different intensities, and exerting different repulsion forces interacting with the pole shoe of the pallet fork-lever when the latter is in immediate proximity to said magnetized areas, the areas immediately next to two neighbouring concentric tracks also having a different level of magnetization. This

The invention proposes to replace the usual mechanical contact force between a stop member and an escape wheel with a contactless force of magnetic or electrostatic origin.

The invention concerns a timepiece escapement mechanism 10 including a stop member 30 between a resonator 20 and an escape wheel set 40.

According to the invention, this escape wheel set 40 includes at least one magnetized or ferromagnetic, or respectively, electrically charged or electrostatically conductive track 50, with a period of travel PD in which the magnetic, or respectively, electrostatic characteristics are repeated.

The invention is illustrated here in the preferred case of a pivoting motion, with an angular travel, and a period of angular travel PD.

Track 50 has identical geometric and physical characteristics over period of travel PD, in particular as regards the composition (materials), profile, possible coating, and possible magnetization or electrical charging thereof.

This stop member 30 includes at least one magnetized or ferromagnetic, or respectively, electrically charged or electrostatically conductive pole shoe 3.

Pole shoe 3 is mobile in a transverse direction DT relative to the direction of travel DD of at least one component of a surface 4 of track 50. This transverse mobility does not involve completely leaving the track concerned, the arrangement varies according to the embodiments, and, in some of them, the pole shoe leaves the track during part of the motion.

At least pole shoe 3 or track 50 creates a magnetic or electrostatic field in an air-gap 5 between said at least one pole shoe 3 and said at least one surface 4.

Pole shoe 3 is confronted by a magnetic or electrostatic field barrier 46 on track 50 just before each transverse motion of stop member 30, this transverse motion being actuated by the periodic action of resonator 20.

Stop member 30 is multi-stable, and is arranged to occupy at least two stable positions.

Preferably the magnetic or electrostatic field created by this at least one pole shoe 3 or by track 50, in an air-gap 5 between the at least one pole shoe 3 and this at least one surface 4, generates a torque or a force which is applied to the at least one pole shoe 3 and the at least one surface 4. This torque or force is a periodic braking torque or force according to the period of angular travel PD, with, starting from a torque or force with a null value, a first half-period including a potential ramp wherein the braking torque or force is substantially constant around a first value V1, and a second part of the period including a potential barrier wherein said braking torque or couple increases and reaches its maximum value which is a second value V2 at least three times greater than the first value V1, and of the same sign as the first value V1, as can be seen in FIG. 28A.

More specifically, each track 50 comprises, before each barrier 46, a ramp 45 interacting in an increasing manner with a pole shoe 3 with a magnetic, or respectively, electrostatic field, whose intensity varies so as to produce increasing potential energy, this ramp 45 taking energy from escape wheel set 40 and each potential barrier is steeper than each potential ramp.

More specifically, escape wheel set 40 includes, between two successive ramps 45 of the same track 50 or two neighbouring tracks 50 in the direction of travel DD, a magnetic, or respectively, electrostatic field potential barrier, for triggering a pause of escape wheel set 40 prior to the tilting of stop member 30 under the periodic action of oscillator 20.

Figure 28:
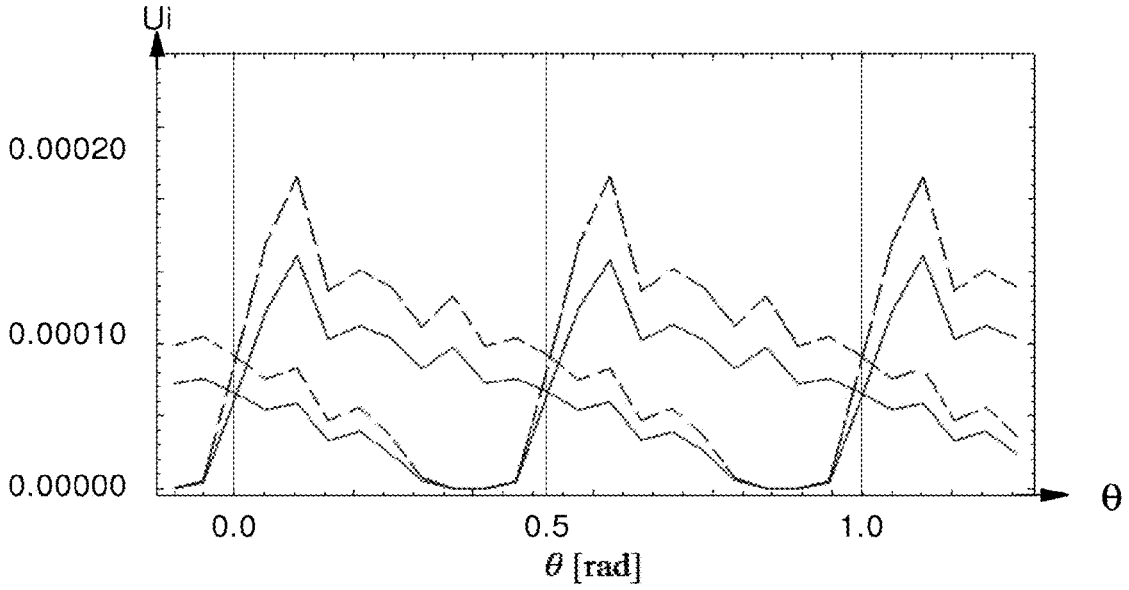
FIG. 28 shows the distribution of potential in the same example, with centring on the track shown in a dash line, and a draw in a solid line.
Figure 28A:
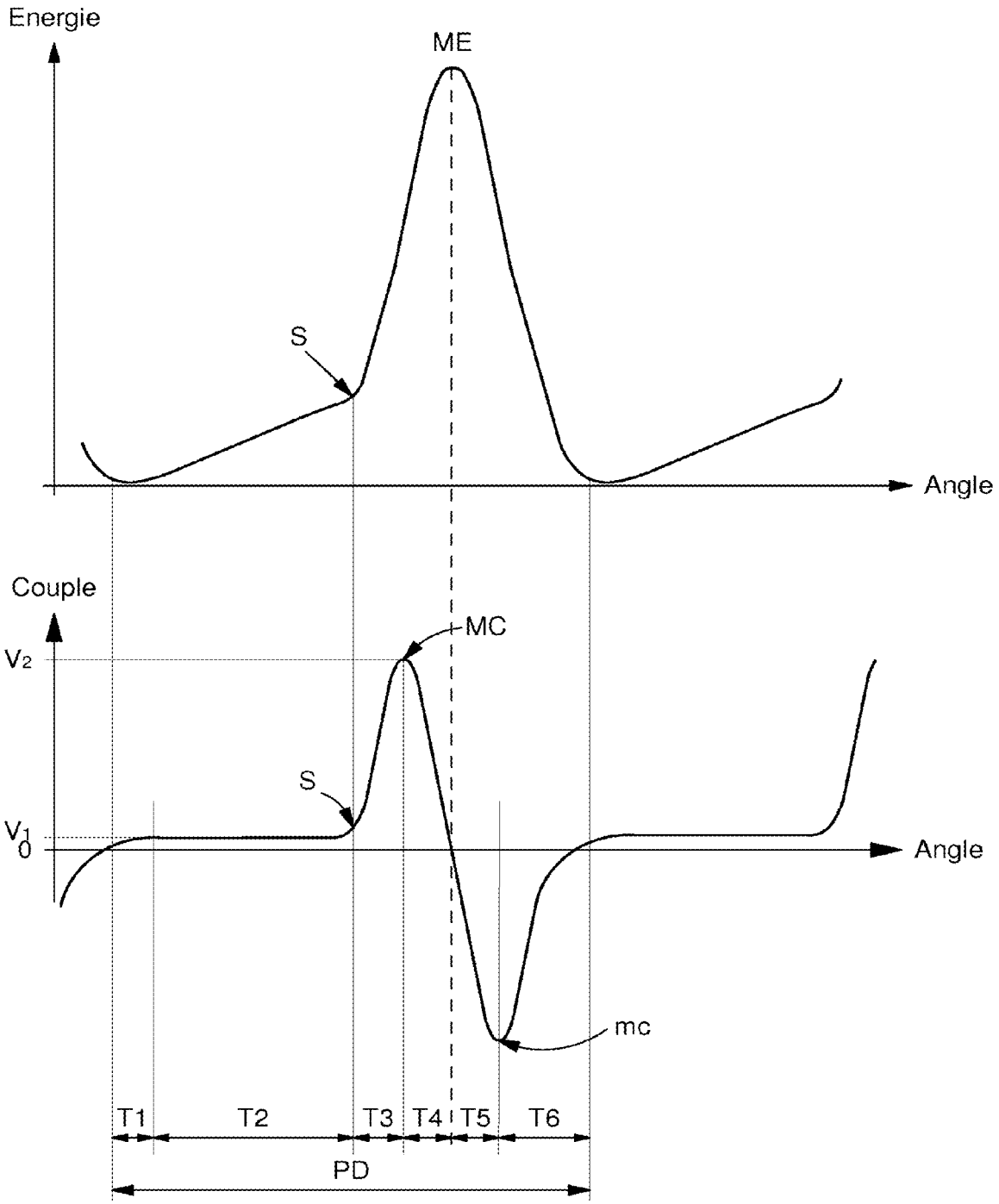
FIG. 28A shows the variation over the period of travel, on the one hand, in the energy level in the top diagram, and on the other hand, in the braking torque in the bottom diagram, which is aligned on the abscissa in the top diagram.

More specifically, and as can be seen in FIG. 28A, the torque or force is a periodic braking torque or force according to the period of angular travel PD. Further, starting from a null torque or force value at the start of period PD, the braking torque or force is of positive intensity with an increasing value over a first angle T1 until reaching a plateau and with a first substantially constant value V1 over a second angle T2, the combination of first angle T1 and second angle T2 forming a potential ramp, until a threshold S is reached, after which the intensity increases up to a second maximum value V2, higher than the first value V1, over a third angle T3. The end of said third angle T3 corresponds to a peak MC at a maximum level of torque or force at second value V2, after which the intensity of the torque or force falls over a fourth angle T4 to reach a null value, which corresponds to a maximum energy level ME. The combination of third angle T3 and fourth angle T4 constitutes a potential barrier on which the braking torque or force is positive. Beyond that point, the braking torque or force continues to fall over a fifth angle T5 to a minimum negative intensity at a trough MC, before rising, over a sixth angle T6 to once again reach a positive value and start on the following period, and where TD=T1+T2+T3+T4+T5+T6, and where T1+T2≥TD/2.

More specifically, the barrier 46 defines a discontinuity threshold through the sudden increase or reduction in torque or force, on a travel corresponding to third angle T3, and this third angle T3 is less than a third of second angle T2.

More specifically, the second maximum value V2 is more than six times the first value V1.

Advantageously, mechanism 10 also includes mechanical stopping means to prevent stop member 30 from changing into negative torque over a fifth angle T5 or a sixth angle T6 in the second half-period.

In a specific embodiment, this escapement mechanism 10 accumulates energy received from escape wheel set 40 during each half of period PD, stores part of it as potential energy, and returns it in a periodic manner to resonator 20. By way of analogy, this accumulation function is equivalent to the gradual winding of a spring in a mechanism. This restitution of energy takes place between these half-periods, during a transverse motion of stop member 30 actuated by the periodic action of resonator 20. Pole shoe 3 then changes from a first transverse half-travel PDC relative to escape wheel set 40 to a second transverse half-travel DDC relative to escape wheel set 40, or vice versa. Pole shoe 3 is confronted by a magnetic or electrostatic field barrier 46 on track 50 just before each transverse motion of stop member 30, actuated by resonator 20, by tilting from one half-travel to the other.

In a specific embodiment, the magnetic or electrostatic field, generated by pole shoe 3 and/or track 50, is of greater intensity in the first half-travel PDC than in the second half-travel DDC during the first half of said period of travel PD, and of greater intensity in the second half-travel DDC than in the first half-travel PDC during a second half of period of travel PD.

More specifically, resonator 20 includes at least one oscillator 2 with a periodic motion. Escape wheel set 40 is powered by an energy source such as a barrel or similar element. Stop member 30 ensures, on the one hand, a first function of transmitting energy from escape wheel set 40 to resonator 20, and on the other hand, a second function of releasing and locking the escape wheel 40 in jerks to advance it by one step during a motion of stop member 30 actuated by resonator 20 at each vibration of oscillator 2. This at least one track 50 is driven in a run motion on a travel trajectory TD.

Preferably, each pole shoe 3 is movable in a transverse direction DT relative to track 50, in a first half-travel PDD and a second half-travel DDC on either side of a fixed median position PM, on a transverse trajectory TT, preferably substantially orthogonal to travel trajectory TD of track 50.

It is at an air-gap 5 between a pole shoe 3 and a surface 4 of a track 50 which faces pole shoe 3, that track 50 and/or pole shoe 3 creates the magnetic or electrostatic field which allows a system of magnetic or electrostatic forces to be created on stop member 30 and escape wheel set 40, instead of the mechanical forces of the prior art.

Escapement mechanism 10 according to the invention accumulates potential energy transmitted from the energy source via escape wheel set 40 during each first half or second half of period of travel PD. At the end of each half-period, pole shoe 3 is opposite a magnetic or electrostatic field barrier 46 on the portion of track 50 opposite which it moves, just before the transverse motion of stop member 30 actuated by resonator 20. It is then that escapement mechanism 10 returns the corresponding energy to oscillator 2 during the transverse motion of stop member 30 periodically actuated by resonator 20 between the first half and second half of the period of travel PD. During this transverse motion, pole shoe 3 changes from the first half-travel PDC to the second half-travel DDC, or vice versa.

Figure 4:
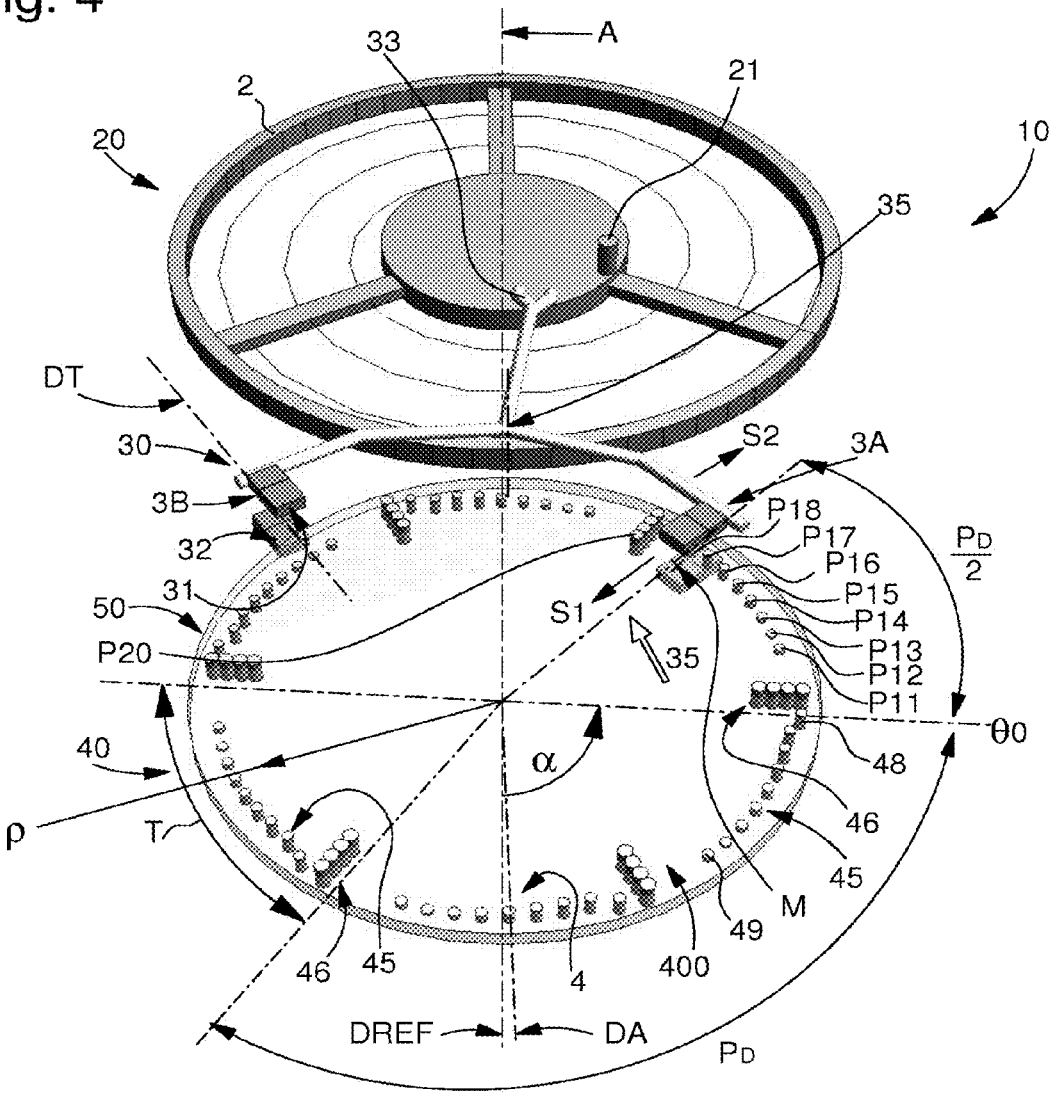
FIG. 4 shows a schematic perspective view of a second embodiment of an escapement mechanism according to the invention, including a pallet fork comprising a plurality of magnetic pole shoes, here in the form of two fork elements each with two pole shoes on each side of the plane of an escape wheel, the two fork elements being arranged on each side of the pivot point of the pallet fork, in a similar manner to the pallet stones of a conventional Swiss lever. The escape wheel is provided with a series of ramps each formed of a sequence of magnets of variable and increasing intensity, each ramp being limited by a barrier of magnets, these different magnets being arranged to interact in succession with the two fork elements of the pallet fork.
Figure 9:
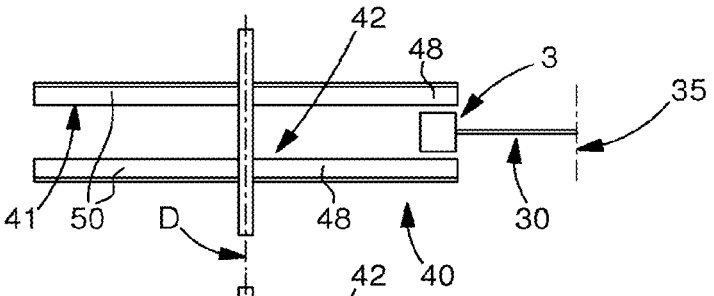
Figure 10:
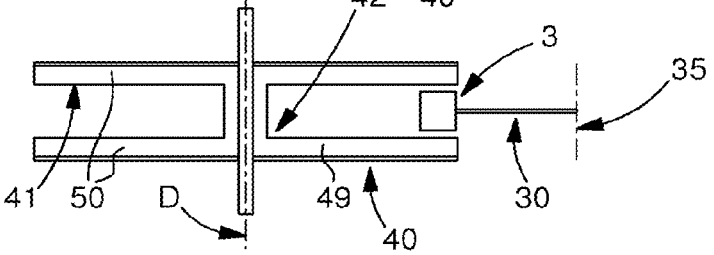
Figure 11:
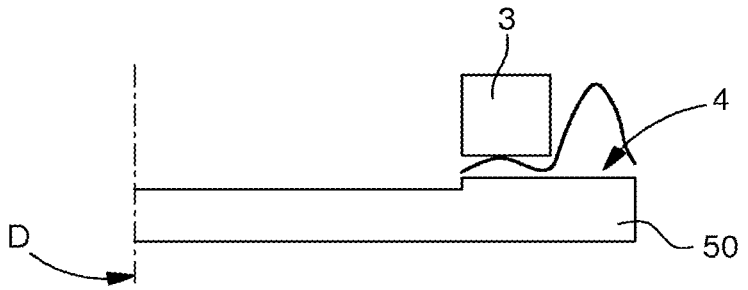
FIGS. 11 to 14 show a schematic view of the magnetic field distribution, in a transverse plane, passing through the pivot axis of the escape wheel of the mechanism of FIG. 1, on the two secondary internal and external tracks, in correlation with the positions shown in FIGS. 2 and 3.
Figure 12:
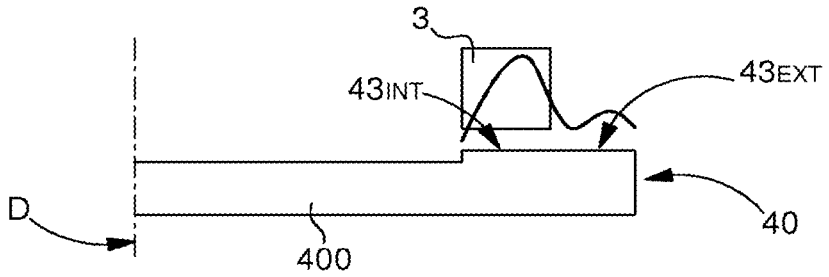
Figure 13:
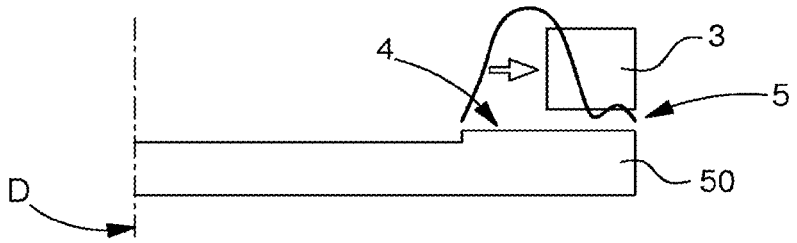
Figure 14:
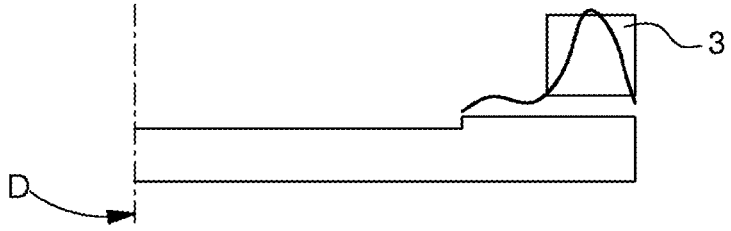
Figure 15:
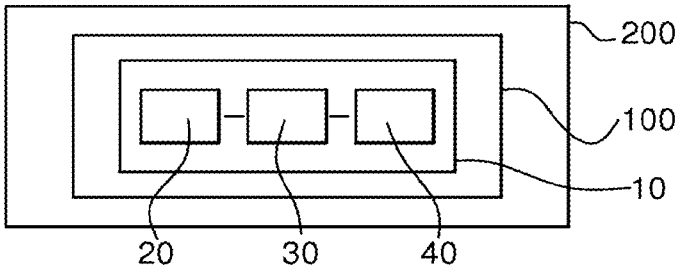
FIG. 15 shows a block diagram of a timepiece including a movement which incorporates an escapement mechanism according to the invention.
Figure 16:
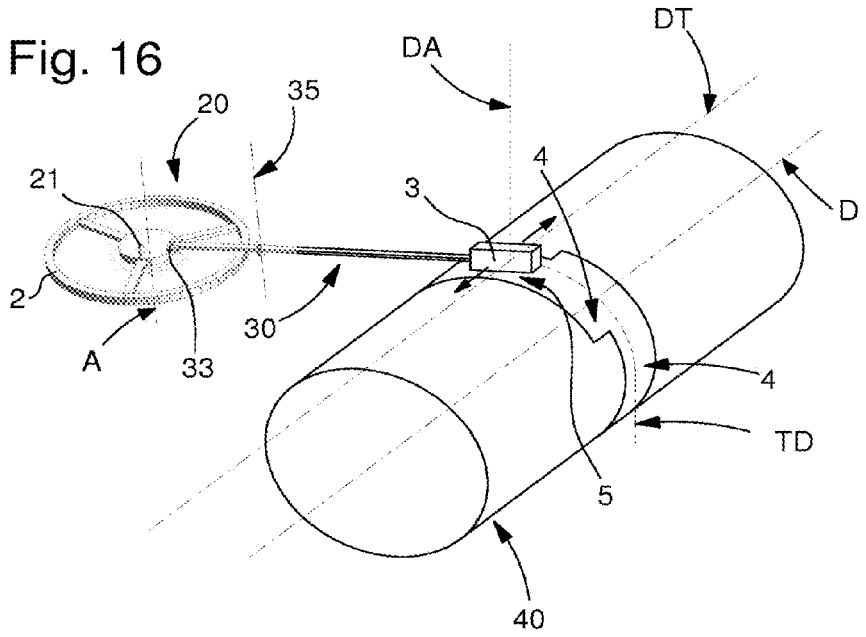
FIG. 16 shows a variant wherein the escape wheel set is a cylinder, the stop member including a mobile pole shoe in proximity to a generatrix of the cylinder.
Figure 17:
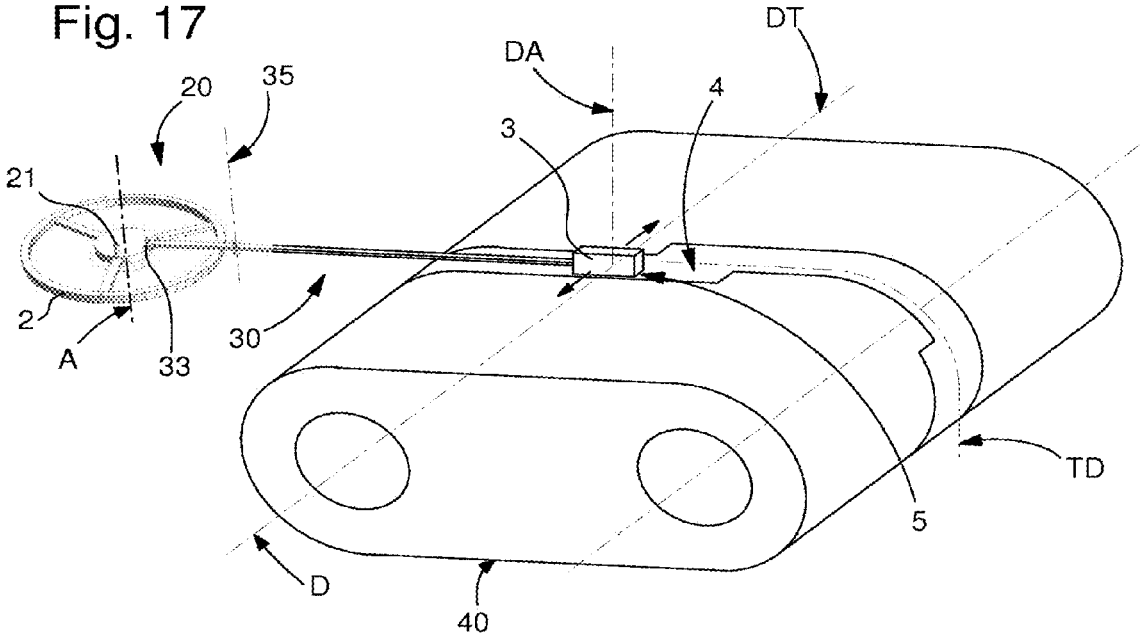
FIG. 17 shows another variant wherein the escape wheel set is a continuous strip.
Figure 29:
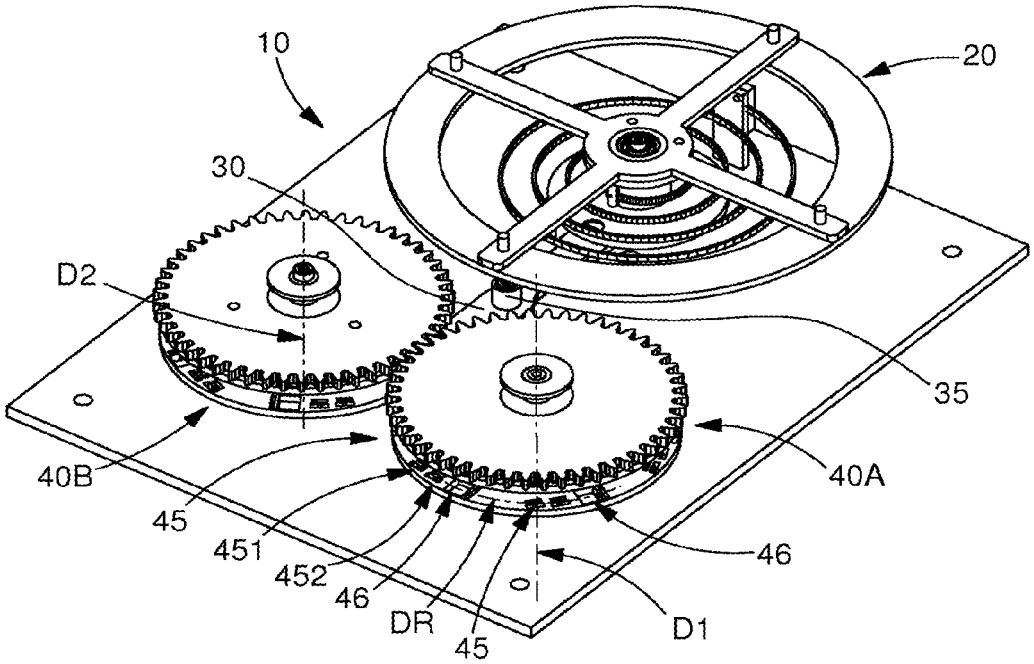
FIGS. 29 to 34 illustrate a natural escapement mechanism according to the invention.

Escape wheel set 4 may be formed in various manners: in the standard form of an escape wheel 400 as shown in FIGS. 1, 4 and 29, or a double wheel as shown in FIGS. 9 and 10, or in the form of a cylinder as shown in FIG. 16, or in the form or a continuous strip as shown in FIG. 17, or another form. This description concerns the general case of a wheel set (not necessarily pivoting), and a watchmaker will know how to apply it to the component of interest, in particular a single or multiple wheel.

Preferably, the characteristics of the magnetic or electrostatic field are alternated between the first half-travel PDC and the second half-travel DDC, with a phase shift of a half-period of travel PD between track 50 and pole shoe 3. However, the device may also be made to operate with, for example, different field intensities, whilst respecting the different rate of distribution of the field between different sectors. This may be the case, for example, in the embodiment in FIG. 1, where the angular sectors limited by the different radii will not necessarily have exactly the same characteristics.

Figure 18:
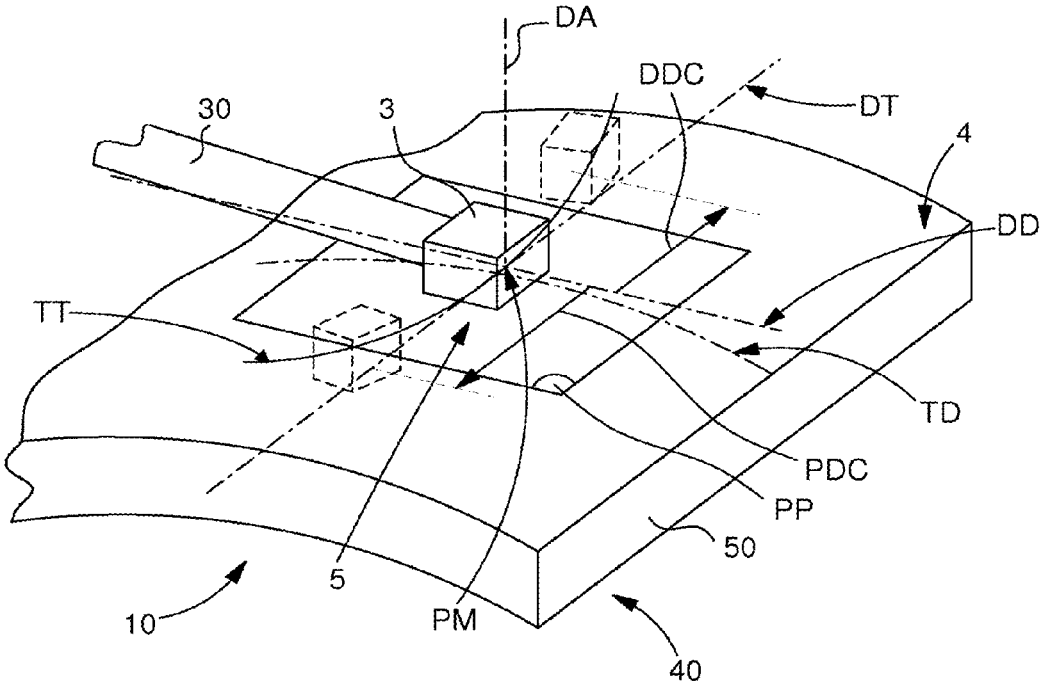
FIG. 18 shows the travel of a pole shoe facing a surface of a left escape wheel set track.

Here transverse direction DT refers to a direction which is substantially parallel to transverse trajectory TT of pole shoe 3, or which is tangent thereto at the median position PM, as shown in FIG. 18.

Here, axial direction DA refers to a direction which is orthogonal both to a transverse direction DT substantially parallel to the transverse trajectory TT of the pole shoe, and to the direction of travel DF of track 50, tangential to the travel trajectory TD at the median position PM.

Here, track plane PP refers to the plane defined by median position PM, transverse direction DT and direction of travel DF.

Preferably, at least one of the two opposing components ("opposing" is used here to mean that the two components are facing each other, without there being any repulsive force, confrontation or other interaction between them), formed by pole shoe 3 and track 50 bearing the surface 4 which faces the pole shoe at air-gap 5 on at least part of their relative travel, includes active magnetic, or respectively, electrostatic means which are arranged to create this magnetic, or respectively, electrostatic field.

The term "active" refers here to a means that creates a field, and "passive" to a means which is subjected to a field. The term "active" does not imply here that a current passes through the component.

In a specific variant, the component of this field in axial direction DA, is higher than its component in track plane PP, at their interface in air-gap 5 between pole shoe 3 and the opposite surface 4.

In a specific variant, the direction of this magnetic or electrostatic field is substantially parallel to axial direction DA of escape wheel set 40. The expression "substantially parallel" refers to a field whose component in axial direction DA is at least four times greater than the component in plane PP.

The other opposing component at air-gap 5 includes therefore, either passive magnetic, or respectively, electrostatic means for cooperating with the field thus created, or also active magnetic, or respectively, electrostatic means which are arranged to create a magnetic, or respectively, electrostatic field at air-gap 5, said field may, according to the case, be in concordance or opposition with the field emitted by the first component, so as to generate a repulsion or conversely an attraction force at air-gap 5.

In a specific embodiment, shown in the first embodiment of FIG. 1 and in a second embodiment of FIG. 4, stop member 30 is arranged between resonator 20 having a sprung balance 2 with a pivot axis A, and at least one escape wheel 400 which pivots about a pivot axis D (which defines with sprung balance pivot axis A an angular reference direction DREF). This stop member 30 ensures a second function of releasing and locking escape wheel set 40 in jerks to advance it by one step at each vibration of sprung balance 2.

Pole shoe 3 is arranged to move, over at least part of the transverse travel, facing at least one element of surface 4 of escape wheel set 40. In the first embodiment of FIG. 1, the pole shoe always faces a surface 4, in the second embodiment of FIG. 4, stop member 30 includes two pole shoes 3A, 3B, and each of them is opposite a surface 4 for one half-period, and remote from surface 4 for the other half-period, in a position where any magnetic or electrostatic interaction between them is negligible.

In one variant, each of the two opposing components on either side of air-gap 5, formed by pole shoe 3 and track 50 bearing the surface 4 that faces the pole shoe over at least part of their relative travel, includes active magnetic, or respectively, electrostatic means, which are arranged to create a magnetic, or respectively, electrostatic field in a direction substantially parallel to axial direction DA, at their interface in air-gap 5.

In an advantageous embodiment, pole shoe 3 and/or track 50 bearing surface 4 which faces the pole shoe at air-gap 5 includes magnetic, or respectively, electrostatic means, which are arranged to create in air-gap 5, in at least one transverse plane PT defined by median position PM of pole shoe 3, by transverse direction DT and axial direction DA, and over the transverse range of relative travel, in said transverse direction, of pole shoe 3 and of surface 4, a magnetic, or respectively, electrostatic field of variable and non-null intensity both according to the transverse position of pole shoe 3 in transverse direction DT, and periodically over time.

In a specific embodiment, each such pole shoe 3 and each such track 50 bearing a surface 4 facing the pole shoe includes such magnetic, or respectively, electrostatic means which are arranged to create a magnetic, or respectively, electrostatic field between at least one such pole shoe 3 and at least one surface 4, in at least said transverse plane PT. This magnetic, or respectively, electrostatic field created by these opposing components is of variable and non-null intensity both according to the radial position of pole shoe 3 in transverse direction DT, and periodically over time.

It is understood that conditions are to be created to allow for the creation of a force of magnetic or electrostatic origin between stop member 30 and escape wheel set 40, to enable driving, or conversely, braking to occur between these two components, without any direct mechanical contact between them.

The conditions for the creation of a magnetic or electrostatic field by one of the components, and the reception of this field by the opposing component, which is itself capable of emitting a magnetic or electrostatic field make it possible to envisage different types of operation, by repulsion or attraction between the two opposing components. In particular, multi-level architectures allow the torques or forces to be balanced in the direction of pivoting of escape wheel set 40 (in particular the direction of the pivot axis if wheel set 40 pivots about a single axis), and the relative position of stop-pin 30 and escape wheel set 40 to be maintained in axial direction DA, as will be explained hereafter.

In a specific embodiment, the component of the magnetic, or respectively, electrostatic field in direction DA, is in the same direction over the entire range of relative travel of pole shoe 3 and of the surface 4 opposite thereto.

Different configurations are possible, according to the nature of the field, and whether stop member 30, and/or escape wheel set 40, play an active or passive role in the creation of a magnetic or electrostatic field in at least one air-gap between stop member 30 and escape wheel set 40. Indeed, there may be several air-gaps 5 between different pole shoes 3 of stop member 30 and different tracks of escape wheel set 40. In a non-limiting manner, various advantageous variants are described hereinafter.

Thus, in a variant, each pole shoe 3 borne by stop member 30 is permanently magnetized, or respectively, electrically charged and generates a constant magnetic, or respectively, electrostatic field, and each surface 4 cooperating with each pole shoe 3 defines with the pole shoe 3 concerned an air-gap 5 in which the magnetic, or respectively, electrostatic field is variable according to the progress of escape wheel set 40 on its trajectory, and is variable according to the relative transverse position of the pole shoe 3 concerned with respect to escape wheel set 40, and which is linked to the angular travel of stop member 30 if it pivots, as in the case of a pallet fork, or the transverse travel thereof if it is driven otherwise by resonator 20.

In another variant, each pole shoe 3 borne by stop member 30 is permanently ferromagnetic, or respectively, electrostatically conductive, and each surface 4 cooperating with each pole shoe 3 defines with the pole shoe 3 concerned an air-gap 5 in which the magnetic, or respectively, electrostatic field is variable according to the progress of escape wheel set 40 on its trajectory and is variable according to the relative transverse position of the pole shoe 3 concerned with respect to escape wheel set 40, and which is linked to the angular travel of stop member 30 if it pivots, as in the case of a pallet fork, or the transverse travel thereof if it is driven otherwise by resonator 20.

In another variant, each track 50 bearing an opposing surface 4 is permanently magnetized, or respectively, electrically charged in a uniform manner, and generates a constant magnetic, or respectively, electrostatic field on the surface thereof facing the pole shoe 3 concerned, and includes a relief portion arranged to generate a variable air-gap height in air-gap 5, whose air-gap height varies according to the progress of escape wheel set 40 on its trajectory, and varies according to the relative angular position of the pole shoe 3 concerned in relation to escape wheel set 40.

In another variant, each track 50 bearing such a surface 4 is permanently ferromagnetic, or respectively, electrostatically conductive and includes a profile arranged to generate a variable air-gap height in air-gap 5, whose air-gap height is variable according to the progress of escape wheel set 40 on its trajectory, and is variable according to the relative transverse position of the pole shoe 3 concerned in relation to escape wheel set 40.

In another variant, each track 50 bearing such a surface 4 is permanently magnetized, or respectively, electrically charged in a variable manner according to the local position on the track, and generates a magnetic, or respectively, electrostatic field which is variable according to the progress of escape wheel set 40 on its trajectory, and is variable according to the relative transverse position of the pole shoe 3 concerned in relation to escape wheel set 40, on the surface thereof facing the pole shoe 3 concerned.

In another variant, each track 50 bearing such a surface 4 is permanently ferromagnetic, or respectively electrostatically conductive, in a variable manner according to the local position on the track, so as to vary the magnetic, or respectively, electrostatic force applied between stop member 3 and escape wheel set 40 as a result of their relative movement; said force is variable according to the progress of escape wheel set 40 on its trajectory, and is variable according to the relative transverse position of the pole shoe 3 concerned in relation to escape wheel set 40, on the surface thereof facing the pole shoe 3 concerned.

In another variant, each pole shoe 3 moves between two surfaces 4 of escape wheel set 40, and a magnetic, or respectively, electrostatic field is applied to each side of pole shoe 3 in axial direction DA in a symmetrical manner on either side of pole shoe 3 so as to apply equal and opposing torques or forces on pole shoe 3 in axial direction DA. Axial balance and minimum torque or force are thus obtained on any pivots, thereby minimising losses through friction.

In another variant, each surface 4 of escape wheel set 40 moves between two surfaces 31, 32 of each pole shoe 3, and a magnetic, or respectively, electrostatic field is applied to each side of surface 4 in axial direction DA in a symmetrical manner on either side of surface 4 so as to apply equal and opposing torques or forces on the track 50 bearing surface 4 in axial direction DA.

In another variant, track 50 of escape wheel set 40 includes, on one of its two lateral surfaces 41, 42, a plurality of secondary tracks 43 which are close to one another.

Figure 2:
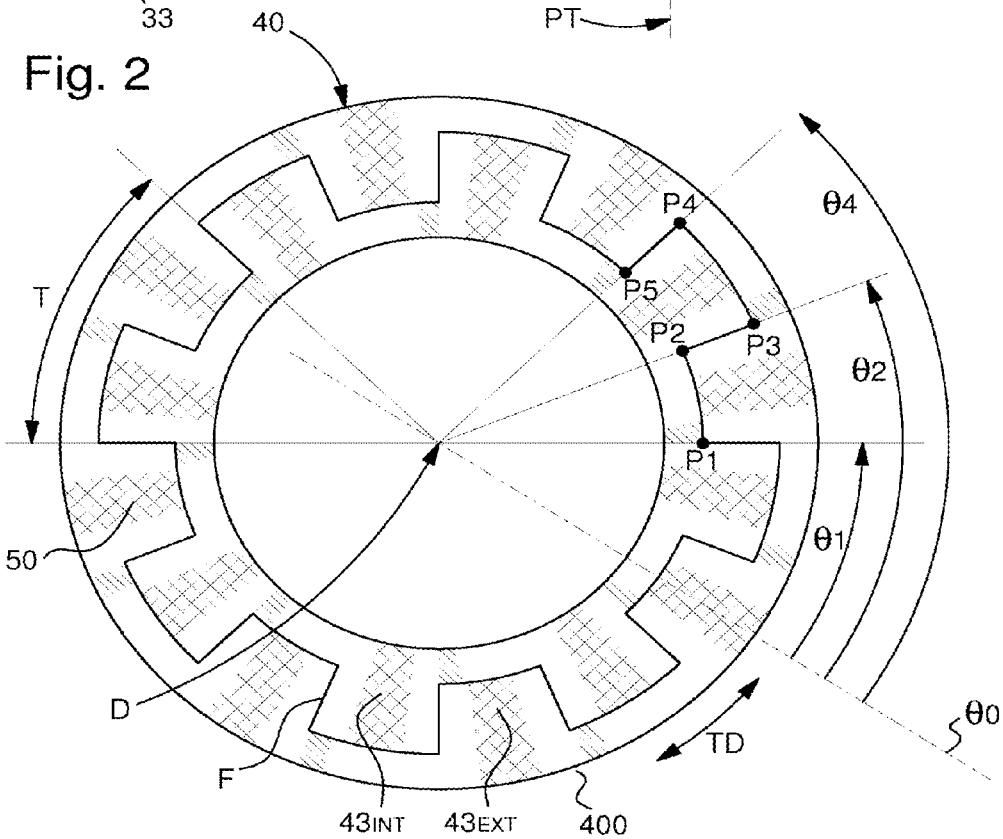
FIG. 2 shows a schematic top view of the distribution of potential magnetic interaction energy experienced by the pole shoe of the pallet fork-lever of FIG. 1 according to its position in relation to the escape wheel, and the broken crenelated line shows the trajectory of the pole shoe of the pallet fork during operation, alternately facing the internal track and the external track of FIG. 1.

In a specific application where escape wheel set 40 is an escape wheel 400, these tracks are concentric with each other in relation to pivot axis D of escape wheel 400, as shown on FIGS. 1 and 2 which show two such secondary tracks, internal 43INT and external 43EXT, and where each secondary track 43 includes an angular series of primary elementary areas 44, each primary area 44 exhibiting a magnetic, or respectively, electrostatic behaviour which is different, on the one hand, from that of the adjacent primary area 44 on the secondary track 43 to which it belongs, and on the other hand, from that of every other primary area 44 which is adjacent thereto and which is situated on another secondary track 43 adjacent to its own secondary track.

Figure 19:
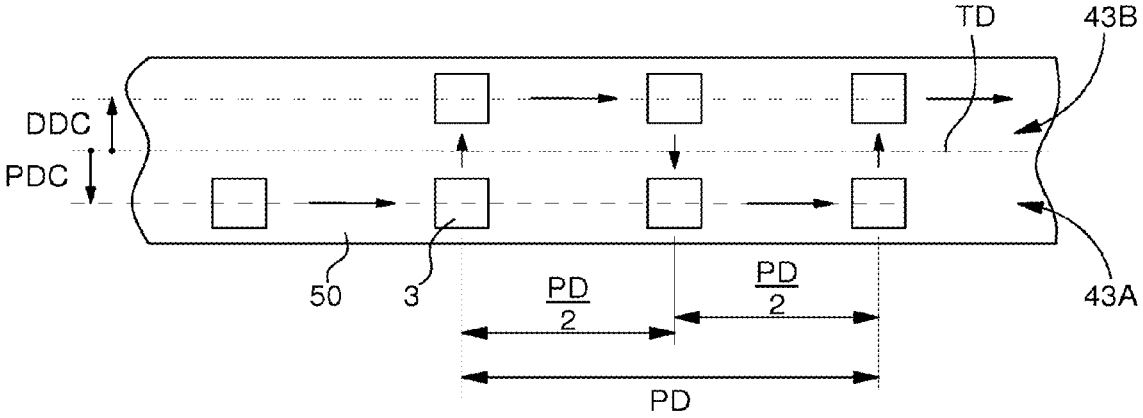
FIG. 19 shows the periodicity of motion of a pole shoe along a track including two parallel secondary tracks.

In other variant embodiments where track 50 is not comparable to a disc, for example in the examples of FIGS. 16 and 17, the secondary tracks 43 are not concentric, but close and preferably substantially parallel to each other. But the difference in magnetic, or respectively, electrostatic behaviour between two immediately adjacent primary areas 44, applies in the same manner. FIGS. 18 and 19 show the travel of a pole shoe 3 in a variant including two adjacent and parallel secondary tracks 43A and 43B phase-shifted by a half-period.

More specifically, the given succession of primary areas 44 on each secondary track 43 is periodic according to a spatial period T, which is angular or linear according to the case, forming an integer sub-multiple of one revolution of escape wheel set 40. This spatial period T corresponds to the period of travel PD of track 50.

In an advantageous embodiment, each secondary track 43 includes, on each spatial period T, a ramp 45 including a series, in particular a monotone series, of primary areas 44 interacting in an increasing manner with a pole shoe 3 with a magnetic, or respectively, electrostatic field, whose intensity varies so as to produce increasing potential energy from a minimum interaction area 4MIN towards a maximum interaction area 4MAX, ramp 45 taking energy from escape wheel set 40.

Specifically according to the invention, between two successive ramps 45 in the same direction, escape wheel set 40 includes a magnetic, or respectively, electrostatic field barrier 46 for triggering a pause of escape wheel set 40 prior to the tilting of stop member 30 under the action of resonator 20, in particular of a sprung-balance 2.

Preferably, each such potential barrier 46 is steeper than each such ramp 45, as regards the potential gradient.

Thus energy barriers are created: in the embodiments shown, these barriers are formed by field barriers. The illustrated variants are therefore magnetic, or respectively, electrostatic field ramps, and field barriers.

More specifically, escape wheel set 40 is immobilised in a position where the potential gradient is equivalent to the drive torque.

This immobilisation is not instantaneous, there is a phenomenon of rebound, which is dampened, either by natural friction, in particular pivot friction, in the mechanism, or by friction created to this end, of a viscous nature, such as eddy current friction (for example on a copper or similar surface integral with escape wheel set 40) or aerodynamic or other friction, or even dry friction such as a jumper spring or other. Typically, escape wheel set 40 is strained by an upstream mechanism with constant torque or constant force, typically a going barrel. Escape wheel set 40 oscillates therefore, before stopping in position, before the transverse tilt of pole shoe 3, and losses are required to stop the oscillation within a kinetically compatible time interval.

The transition between the ramp and the barrier may be devised and adjusted so as to obtain a particular dependence between the energy transmitted to the resonator as a function of the drive torque.

Although the invention can operate using a ramp having a continuous gradient, it is more advantageous to combine a ramp 45 with a certain gradient, and a barrier 46 with a different gradient, the shape of the transition area between ramp 45 and barrier 46 having a significant influence on operation.

It is understood that, according to the invention, the system accumulates energy as the ramp is climbed, and returns energy to the resonator during the transverse motion of the pole shoe. The stop point defines the quantity of energy thus returned, which depends on the shape of this transition zone between the ramp and the barrier.

Figure 20:
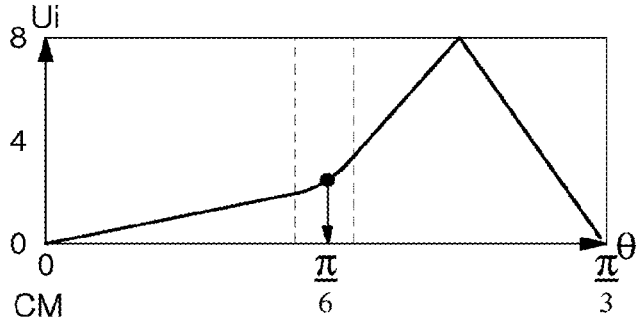
FIGS. 20 to 25 show ramp and barrier profiles, and the energy transmitted for each of these profiles.
Figure 21:
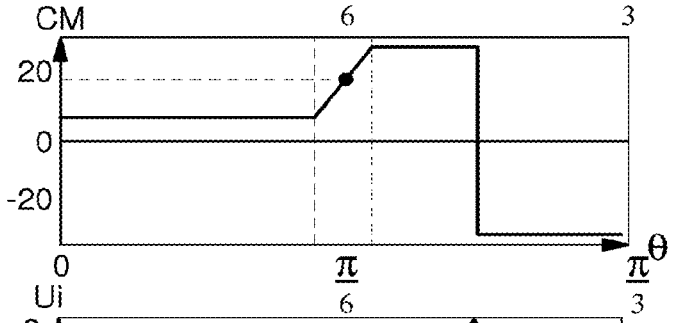
Figure 22:
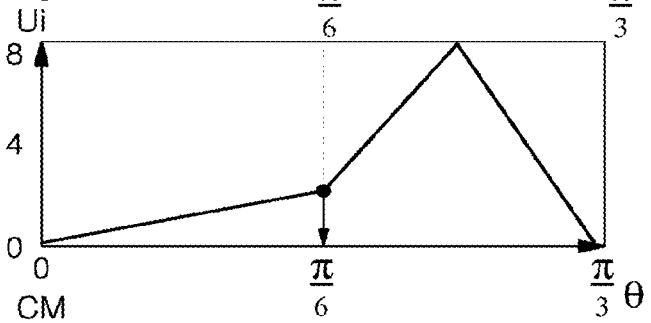
Figure 23:
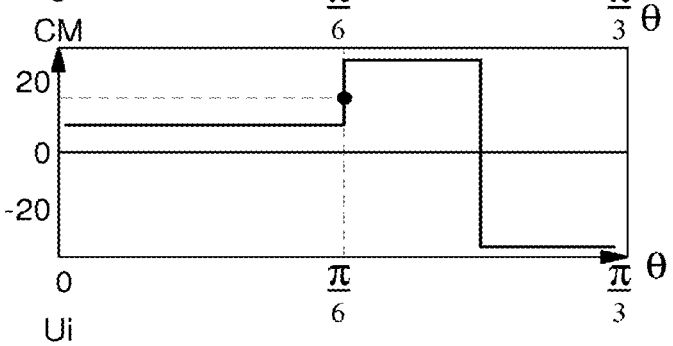
Figure 24:
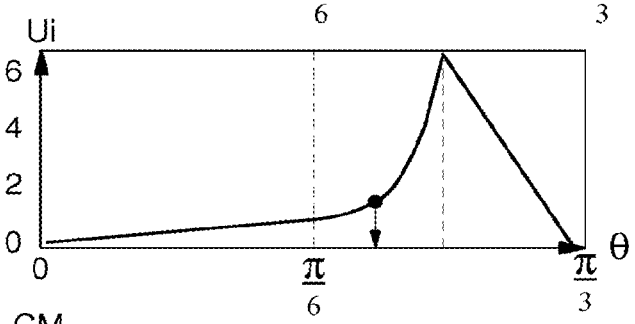
Figure 25:
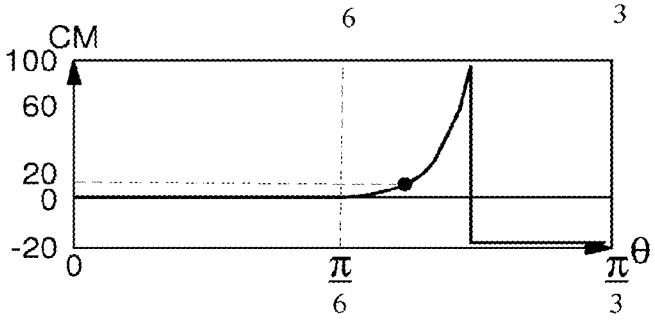

FIGS. 20, 22 and 24 show non-limiting examples of ramp and barrier profiles, with the travel on the abscissa, here a pivoting angle θ, and the energy Ui expressed in mJ on the ordinate. FIGS. 21, 23, and 25 show the transmitted energy, in correlation with each ramp and barrier profile, with the same abscissa, and the torque CM in mN·m on the ordinate.

FIGS. 20 and 21 show a gentle transition with a radius between the ramp and the barrier, the stop point for the system depends on the torque applied, and the energy transmitted to the resonator also depends on the torque applied.

FIGS. 22 and 23 show a transition with an interruption in the gradient between the ramp and the barrier, the point where the system stops does not therefore depend on the torque applied, and the energy transmitted to the resonator is constant.

FIGS. 24 and 25 concern a transition of exponential form between the ramp and the barrier, chosen so that the energy transmitted to the resonator is approximately proportional to the torque applied, and in particular in a specific variant, is substantially equal to the drive torque. This example is advantageous as it is extremely close to a Swiss lever escapement and therefore allows the invention to be incorporated in an existing movement with minimum modification.

In an advantageous variant of the invention, escape wheel set 40 includes again, at the end of each such ramp 45 and just before each barrier 46, a transverse variation in the distribution of the magnetic or electrostatic field when surface 4 is magnetized, or respectively, electrically charged or a profile variation when surface 4 is ferromagnetic, or respectively, electrostatically conductive, causing a draw on pole shoe 3.

Advantageously, escape wheel set 40 includes, after each such magnetic or electrostatic field potential barrier 46 a mechanical shock absorbing stop member.

In a variant, when escape wheel set 40 includes several secondary tracks 43, at least two such adjacent secondary tracks 43 include, in relation to each other, alternating areas of minimum interaction 4MIN and areas of maximum interaction 4MAX with an angular phase-shift of a half-period of spatial period T.

In a variant of the invention, stop member 30 includes a plurality of such pole shoes 3 arranged to cooperate simultaneously with distinct secondary tracks 43, as shown in particular in the second embodiment of FIG. 4, with distinct pole shoes 3A and 3B, each including two magnets 31 and 32 on either side of escape wheel 400.

Notably, in a specific embodiment (not illustrated), stop member 30 may include a comb extending parallel to surface 4 of escape wheel set 40 and including pole shoes 3 placed side by side.

In a variant of the invention, stop member 30 pivots about a real or virtual pivot 35, and includes a single pole shoe 3 arranged to cooperate with primary areas 44 comprised in surfaces 4 situated on different zones of escape wheel set 40 (or respectively different diameters for an escape wheel 400), with which pole shoe 3 interacts in a variable manner during the advance (or respectively the revolution) of escape wheel set 40. These primary areas 44 are arranged alternately on the rim (or respectively the periphery) of escape wheel set 40 to restrict pole shoe 3 to a transverse motion in relation to escape wheel set 40 when a position of equilibrium is sought for pole shoe 3.

In another variant of the invention, stop member 30 pivots about a real or virtual pivot 35, and includes a plurality of pole shoes 3 each arranged to cooperate with primary areas 44 comprised in surfaces 4 situated on at least one zone (respectively one diameter) of escape wheel set 40, with which each such pole shoe 3 interacts in a variable manner during the advance (or respectively the revolution) of escape wheel set 40. These primary areas 44 are placed alternately on the rim or the periphery of the escape wheel set 40 to restrict pole shoe 3 to a transverse motion in relation to escape wheel set 40 when a position of equilibrium is sought for pole shoe 3.

In a specific embodiment, at every moment at least one pole shoe 3 of stop member 30 is in interaction with at least one surface 4 of escape wheel set 40.

In a specific embodiment, stop member 30 cooperates, on either side, with a first escape wheel set and a second escape wheel set.

In a specific embodiment, these first and second escape wheel sets pivot integrally.

In a specific embodiment, these first and second escape wheel sets pivot independently of each other.

In a specific embodiment, these first and second escape wheel sets are coaxial.

In a specific embodiment, stop member 30 cooperates, on either side, with a first escape wheel 401 and a second escape wheel 402, each of which form an escape wheel set 40.

In a specific embodiment, these first 401 and second 402 escape wheels pivot integrally.

In a specific embodiment, these first 401 and second 402 escape wheel sets pivot independently of each other.

In a specific embodiment, these first 401 and second 402 escape wheels are coaxial.

In a variant shown in FIG. 16, escape wheel set 40 includes at least one cylindrical surface 4 about a pivot axis D parallel to transverse direction DT, and which bears magnetic, or respectively, electrostatic tracks, and the at least one pole shoe 3 of stop member 30 is movable parallel to pivot axis D.

FIG. 17 shows a generalisation of the arrangement wherein escape wheel set 40 is a mechanism extending in a direction D, represented here by an endless strip moving over two rollers whose axes are parallel to transverse direction T, said strip bearing at least one surface 4.

Naturally other configurations may be imagined to ensure the spatial periodicity of surfaces 4 on the track or tracks 50, for example on a chain, a ring, a helix, or other.

According to the invention, and in a non-limiting manner, surface 4 may include a magnetized layer of variable thickness, or respectively, an electrically charged layer of variable thickness, or a magnetized layer of constant thickness but variable magnetization, or respectively, an electrically charged layer of constant thickness but variable electrical charge, or micro-magnets with variable surface density, or respectively, electrets with variable surface density, or a ferromagnetic layer of variable thickness, or respectively, an electrostatically conductive layer of variable thickness, or a ferromagnetic layer of variable shape, or respectively, an electrostatically conductive layer of variable shape, or a ferromagnetic layer with variable hole surface, or respectively, an electrostatically conductive layer with variable hole surface density.

In a specific embodiment, stop member 30 is a pallet fork.

The invention also concerns a timepiece movement 100 including at least one escapement mechanism 10 of this type.

The invention also concerns a timepiece 200, particularly a watch, including at least one such movement 100, and/or including at least one such escapement mechanism 10.

The invention is applicable to timepieces on different scales, in particular watches. It is advantageous for static pieces such as clocks, lounge clocks, Morbier clocks, and suchlike. The spectacular and innovative nature of operation of the mechanism according to the invention provides an additional novel benefit to displaying the mechanism and is appealing to the user or spectator.

The Figures show a specific non-limiting embodiment, wherein stop member 30 is a pallet fork, and illustrate how the invention makes it possible to replace the usual mechanical contact force between a pallet fork and an escape wheel by a contactless force of magnetic or electrostatic origin.

Two non-limiting embodiments, are proposed: a first embodiment with a single pole shoe and a second embodiment with several pole shoes.

Figure 3:
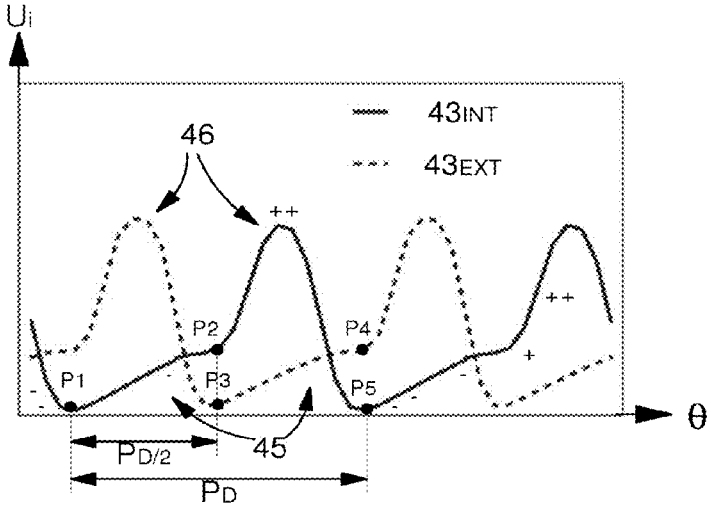
FIG. 3 is a diagram, again for the first embodiment of FIGS. 1 and 2, showing the variation in potential energy (on the ordinate) along the magnetized tracks, according to the central angle (on the abscissa), for each of the two tracks of FIG. 1: the internal track is shown as a solid line, and the external track as a dotted line. This diagram shows the accumulation of potential energy taken from the escape wheel on the sections P1-P2 and P3-P4 each corresponding to a half-period, and the return of said energy by the pallet fork to the balance when pole shoe P2-P3 and P4-P5 changes track.

The first embodiment is illustrated, in a magnetic version only, in FIGS. 1 to 3.

FIG. 1 shows a schematic view of an escapement mechanism 10 with a magnetic stop member 30, wherein this stop member 30 is a pallet fork. The regulating device includes a resonator 20 with a sprung balance 2, a magnetic pallet fork 30, and an escape wheel set 40 formed by a magnetized escape wheel 400. The magnet 3 of the pallet fork interacts in a repulsive manner with the concentric, magnetized, secondary tracks 43INT and 43EXT of escape wheel set 40.

The symbols −−/−/+/++, on secondary tracks 43 represent the intensity of magnetisation, increasing from −− to ++: magnet 3 of pallet fork 30 is weakly repelled by an area −−, but strongly repelled by an area ++.

In the block diagram in FIG. 1, the interactive force between stop member 30 and escape wheel set 40 results from the interaction between a pole shoe 3, in particular a magnet, placed on pallet fork 30, and a magnetized structure placed on escape wheel set 40. This magnetized structure is composed of two secondary tracks 43 (internal track 43INT and external track 43EXT) whose intensity of magnetization varies with angular position to produce the magnetic interaction potential shown in FIG. 2. Along each of the secondary tracks 43, a series of ramps 45 and potential barriers 46 can be seen, as shown in FIG. 3. The effect of ramps 45 is to take energy from escape wheel set 40, and the effect of barriers 46 is to block the advance of wheel set 40. The energy taken by a ramp 45 is then returned to sprung balance resonator 20 when pallet fork 30 tilts from one position to the other.

FIG. 2 shows a schematic diagram of the potential energy from magnetic interaction experienced by magnet 3 of pallet fork 30 according to its position on escape wheel set 40. The dotted line shows the trajectory of a reference point M on magnet 3 of pallet fork 30 during operation.

FIG. 3 shows a schematic diagram of the variation in potential energy along the magnetized secondary tracks 43 of wheel set 40. When pole shoe 3 of the pallet fork passes from point P1 to point P2 on the inner secondary track 43INT, the system takes energy from escape wheel set 40 and stores it in the form of potential energy. The system then stops at P2 under the combined effect of potential barrier 46 and the friction of wheel set 40. Finally, when pallet fork 30 tilts under the action of sprung balance 2 on the opposite end of pallet fork 30, the energy previously stored is returned to sprung balance 2 resonator 20, whilst the system passes from P2 to P3, which corresponds to the change of track, with pole shoe 3 moving at P3 onto the external secondary track 43EXT. The same cycle begins again then on the other secondary track 43EXT passing from P3 to P4 and from P4 to P5 with a return to P5 on the internal track 43INT.

In this magnetic variant of the first embodiment, the form of the potential magnetic interaction is preferably such that:

- potential ramps 45 are devised such that the energy supplied to sprung balance resonator 20 is sufficient to maintain its motion;

the height of potential barriers 46 is sufficient to block the system.

The friction of wheel set 40 makes it possible to immobilise the system at the foot of potential barrier 46.

To maintain the safety of the pallet fork in the event of shocks, it is advantageous to arrange mechanical stop members just after each magnetic potential barrier 46 (these mechanical stop members are not shown in FIG. 1 to avoid overloading the drawing). In normal operation, magnetic pallet fork 30 never touches the mechanical stop members. However, in the event of a shock which is large enough to cause the system to cross a potential barrier 46, these mechanical stop members can block the system to avoid losing steps.

In this variant; the quantity of energy transmitted to sprung balance resonator 20 is always virtually the same, provided that the potential barriers 46 are far steeper than the energy ramps 45. This condition is easy to achieve in practice.

The tilting of pallet fork 30 is decoupled from the motion of escape wheel set 40. More specifically, when pallet fork 30 moves, the potential energy can be returned to the sprung balance 2 resonator 20, even if escape wheel set 40 remains immobile. Thus the impulse rapidity is not limited by the inertia of escape wheel set 40.

Several solutions may be envisaged to create the potential proposed in FIG. 1. The magnetized structure placed on the escape wheel may, in a non-limiting manner, be made with:

- a magnetized layer of variable thickness,
- a magnetized layer of constant thickness but of variable magnetization,
- micro-magnets with variable surface density,
- a ferromagnetic layer of variable thickness (in which case the force is always a force of attraction),
- a ferromagnetic layer of variable profile and/or shape (stamping, cutting),
- a ferromagnetic layer with variable hole surface density, it being possible to combine these arrangements.

The second embodiment is illustrated in FIGS. 4 to 10. This second embodiment operates in the same manner as the first embodiment. The main differences are as follows:

- there is a single magnetized track 50 on escape wheel set 40, including a series of magnets 49, but pallet fork 30 bears two magnetized structures 3A, 3B, so as to reproduce the same interaction potential with alternating ramps and barriers as that presented in FIGS. 2 and 3 of the first embodiment,
- magnets 49 of escape wheel 400 are sandwiched between the magnets 31 and 32 of pallet fork 30, so that the axial repulsion forces compensate each other. Therefore, only the force component which is useful for operation of the escapement remains in the plane of escape wheel set 40.

Advantageously, rather than being exactly above track 50 (or 43 as the case may be), a pole shoe 3 is slightly offset in a transverse direction DT in relation to the axis of the track concerned, so that the interaction between wheel set 40 and pole shoe 3 permanently produces a small transverse force component, which holds stop member 30 in position. The value of the offset is then adjusted so that the force produced maintains the pole shoe 3 in a stable manner in each of its extreme positions, in the first half-travel and the second half-travel.

FIG. 4 thus shows a regulating device formed of a sprung balance 2 resonator 20, a magnetic pallet fork 30, and a magnetized escape wheel 40. Escapement wheel set 40 is provided with a track of magnets 49 of variable intensity which interact with the two magnets 31 and 32 of pallet fork 30. FIG. 4 shows the positioning of magnets 49 of increasing magnetization (in particular of increasing dimensions) so as to form ramps 45 (from P11 to P18) before stopping on barriers 46 formed, for example, by several magnets P20.

Most of the draw is produced by a fine adjustment of the transverse position of pole shoe 3 in relation to track 50 with which it interacts. More specifically, when stop member 30 is positioned at the end of the first half-travel (PDC) or at the end of the second half-travel (DDC), the transverse position of pole shoe 3 which interacts with track 50 is adjusted (by a slight transverse shift) such that pole shoe 3 is subject to a transverse force, or draw, which is sufficient to hold pole shoe 3 in its end position in a stable manner. At the moment at which resonator 20 triggers the tilting of stop member 30, it must overcome this draw before the magnetic or electrostatic force takes over to drive stop member 30 after the tilting, and thus transmit the accumulated potential energy to resonator 20. The draw effect obtained by a transverse shift of 2 mm is illustrated in FIG. 28, for the specific embodiment of FIGS. 26 and 27.

It is understood that, in an escapement mechanism of the invention, resonator 20, in particular balance 2, gives the initial impulse to stop member 30. However, as soon as the draw has been overcome, the forces of magnetic or electrostatic origin take over and perform their role to move pole shoe 3 in a transverse direction to its new position.

Advantageously, at least one magnet 48 which is set back (here placed on a higher positioning radius) in relation to the centring of a ramp 45 along a given radius, enhances the draw effect just before barrier 46. The effect of ramps 45 and barriers 46 is similar to that of the first embodiment, the relative distribution is similar to FIG. 2.

Figure 5:
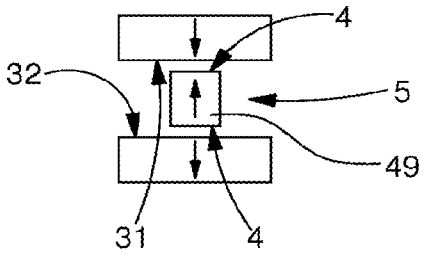
FIG. 5 is a cross-section of a fork element of the pallet fork of FIG. 4, and the direction of the fields of the various magnetized sectors of the pallet fork and of the escape wheel.

FIG. 5 shows a detailed view of the arrangement of magnets 31 and 32 on the pallet fork in relation to magnets 49 of escape wheel set 40.

Figure 26:
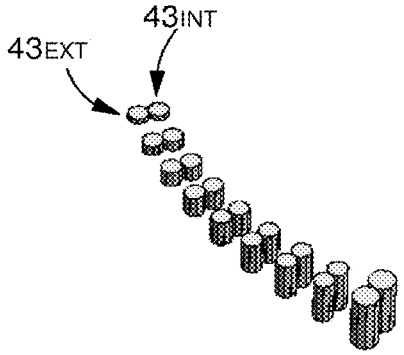
FIG. 26 partially illustrates a similar embodiment to that of FIG. 4, but including two concentric rows of magnets of increasing magnetization, those on the internal track being polarized upwards, and those on the external track being polarized downwards.
Figure 27:
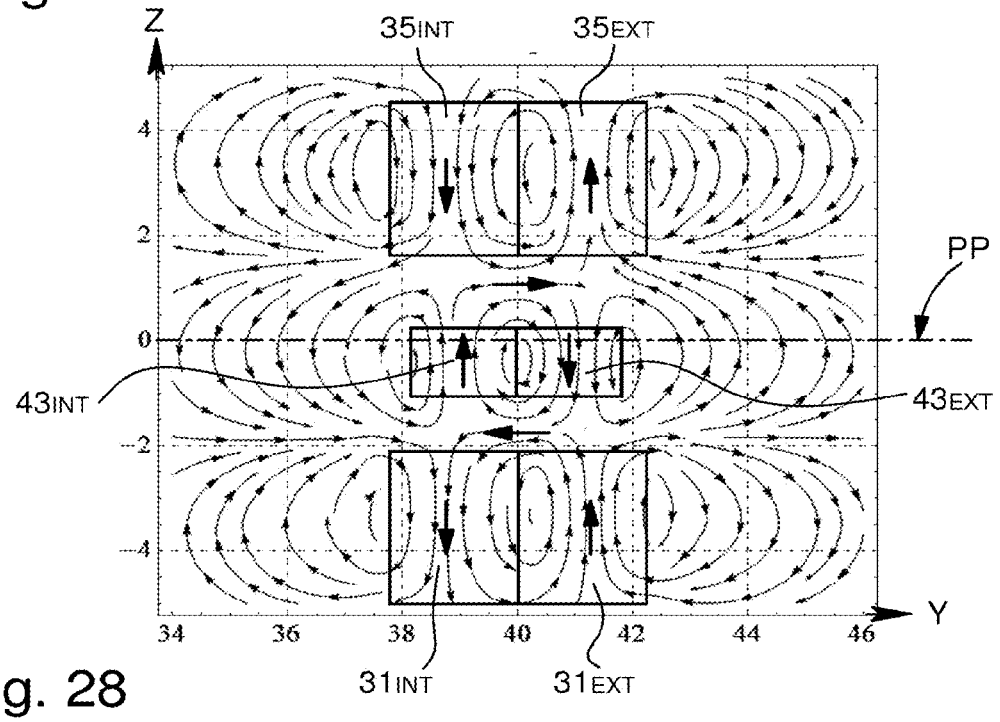
FIG. 27 shows a schematic view of the orientation of the field lines in a transverse cross-section corresponding to the embodiment of FIG. 26.

FIG. 26 shows a similar embodiment to that of FIG. 4, but including two concentric rows of magnets of increasing magnetization, those on the internal track 43INT being polarized upwards, and those on the external track 43EXT being polarized downwards, Pole shoes 3 have opposite configurations: an upper internal pole shoe 3SINT is polarized downwards an upper external pole shoe 3SEXT is polarized upwards, a lower internal pole shoe 3IINT is polarized downwards, and an external lower pole shoe 3IEXT is polarized upwards. FIG. 27 shows a schematic diagram of the orientation of the field lines in a transverse cross section corresponding to this embodiment, wherein the field lines are substantially normal to plane PP of wheel 40 in the magnets, and substantially parallel to this plane in each air-gap 5. The resulting potential, seen in FIG. 28, has alternate ramps and barriers.

In this second embodiment, pallet fork 30 tilts. Preferably, at a given moment, at the most one pole shoe 3A or 3B is facing surface 4 of magnets 49 of escape wheel set 40.

Figure 6:
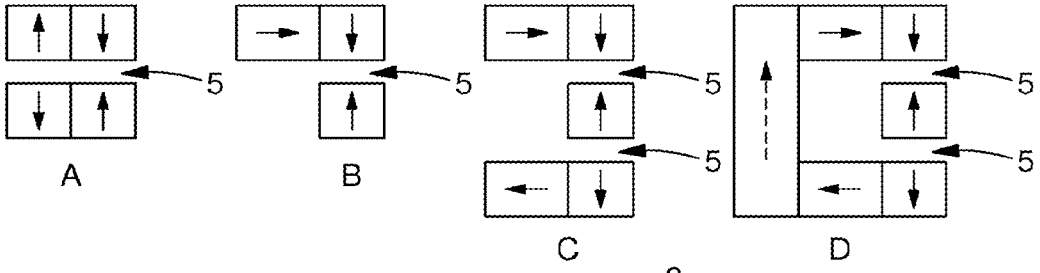
FIG. 6 shows a cross section, in a transverse plane in which there cooperate an escape wheel set and stop member according to the invention, of different variants of the arrangement of magnets cooperating to concentrate a magnetic field in an air-gap area.

FIG. 6 shows how to enhance the concentration of the field in air-gap 5, in a magnetic example:

- in A magnets of opposite polarities are placed head to tail on each side of air-gap 5, which is locally exposed only to polarities which are opposite to one another,
- in B the efficiency of at least one magnet, here the upper magnet, is enhanced by at least one magnet placed in a transverse direction DT to its field,
- in C, two air-gaps on either side of a magnet (as also shown in FIG. 5) are bordered on either side by two assemblies of magnets according to the example B above, in D, the field is moving through a ferromagnetic or magnetized coupling bar, which joins the transverse magnets, in line with their direction of magnetization in the magnetized variant.

Still in this purely magnetic example, several manners may be envisaged for creating the magnetic interaction between stop member 30 (in particular a pallet fork) and escape wheel set 40 (in particular an escape wheel). Four possible non-limiting configurations are presented in FIGS. 7 to 10. The configurations in FIGS. 9 and 10 have the advantage of better confining the magnetic field lines, which is important in reducing the sensitivity of the system to external magnetic fields.

Figure 7:
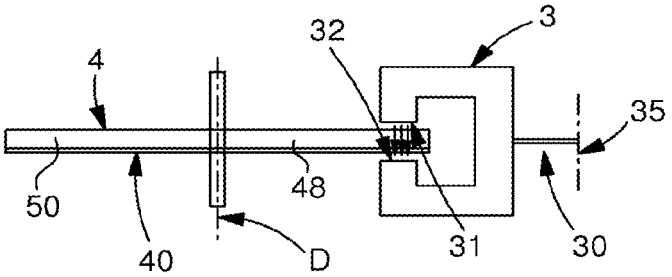
FIGS. 7 to 10 show a cross-section, in a plane passing through the axis of an escape wheel set and through an opposing pole shoe of a stop member in a position of cooperation, of their respective compositions in different embodiments.

According to FIG. 7, a magnetized structure of variable thickness or intensity arranged on an escape wheel interacts with a magnetic field created by a magnetic circuit integral with a pallet fork. The interaction may be repulsive or attractive.

Figure 8:
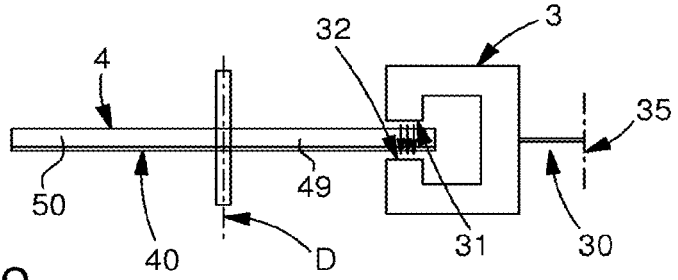

In FIG. 8, a ferromagnetic structure of a variable thickness (or with a variable air-gap) interacts with a magnetic field created by a magnetic circuit integral with a pallet fork.

FIG. 9 shows two magnetized structures of variable thickness or intensity arranged on two sides of an escape wheel, in interaction with a magnetic field created by a magnet integral with a pallet fork, or with a magnetic circuit without a field source integral with a pallet fork. The interaction may be repulsive or attractive.

FIG. 10 shows two ferromagnetic structures of variable thickness (or with a variable air-gap) on two sides of an escape wheel, which are in interaction with a magnetic field created by a magnet or a magnetic circuit with a field source integral with a pallet fork.

On the opposite side of pole shoe 3, or pole shoes 3 if the stop member includes several of them, stop member 30, in particular a pallet fork, includes means of cooperation with resonator 20 (in particular a sprung balance 2), which interact with the resonator to trigger the transverse motion of pole shoe 3. In a known manner, these cooperation means may use a mechanical contact, such as a pallet fork cooperating with a balance impulse pin. It is possible to envisage extrapolating the stop member-escape wheel set cooperation proposed by the invention to the cooperation between the resonator and stop member, which would enable a force of magnetic or electrostatic origin to be used for such cooperation with the object of further minimising friction. An additional advantage of omitting an impulse pin is that it allows for cooperation over an angular range of more than 360°, for example with a helical track.

In a specific variant of the invention, pole shoe 3 is symmetrical in the transverse direction.

In an embodiment example based on the second embodiment of FIG. 4, satisfactory results are obtained with the following values:

Escape wheel inertia: $2*10^{-5}$ kg*m$^2$
Drive torque: $1*10^{-2}$ Nm
Balance inertia: $2*10^{-4}$ kg*m$^2$
Elastic constant of the balance spring: $7*10^{-4}$ Nm
Resonator frequency: 0.3 Hz
Resonator quality factor: 20
Energy ramp height: $2*10^{-3}$ Joule
Energy barrier height: $8*10^{-3}$ Joule
Magnets:
- the pole shoes on the pallet fork are formed of four rectangular NdFeB (neodymium-iron-boron) magnets with the dimensions 5 mm×5 mm×2.5 mm.
- the track is formed of ramps and barriers as follows: the field ramps are produced by cylindrical NdFeB magnets, 1.5 mm in diameter and between 0 and 4 mm in height, and each barrier is formed of four cylindrical NdFeB magnets, 2 mm in diameter and 4 mm in height.

FIGS. 29 to 34 illustrate a natural escapement mechanism according to the invention.

As presented below, this timepiece escapement mechanism 10 comprises a stop member 30 between, on the one hand, a resonator 20, and on the other hand a first escape wheel set 40A and a second wheel set 40B, each subjected to a torque. More specifically, each of these escape wheel sets 40A, 40B has its own gear train.

The invention is described here in a particular case, which is advantageous in terms of size, with only two, substantially coplanar escape wheel sets 40. The invention is, however, applicable to a higher number of escape wheel sets, especially distributed over several parallel levels, and cooperating with as many levels of a single stop member cooperating with the resonator. The invention also allows for three-dimensional architectures, since the interaction between stop member 30 and the wheel sets is not necessarily plane.

According to the invention and preferably, each escape wheel set 40A, 40B includes at least one magnetized or ferromagnetic, or respectively, electrically charged or electrostatically conductive track 50, with a period of travel PD in which the magnetic, or respectively, electrostatic characteristics are repeated.

Stop member 30 includes at least one magnetized or ferromagnetic, or respectively electrically charged or electrostatically conductive pole shoe 3, said pole shoe 3 being movable in a transverse direction DT relative to the direction of travel DD of at least one element of a surface 5 of track 50 which stop member 3 faces. At least pole shoe 3 or track 50, or both, create a magnetic or electrostatic field in an air-gap 5 between said at least one pole shoe 3 and said at least one surface 4.

Pole shoe 3 is confronted by a magnetic or electrostatic field barrier 46 on track 50 just before each transverse motion of stop member 30 actuated by the periodic action of resonator 20.

First escape wheel set 40A is subjected to a first torque and second escape wheel set 40B is subjected to a second torque; they are each arranged to be capable of cooperating alternately with stop member 30. First wheel set 40A and second wheel set 40B are connected to each other by a direct kinematic connection. Preferably, first escape wheel set 40A and second wheel set 40B pivot about distinct axes D1, D2, which are parallel to each other.

The specific arrangements described above and illustrated by all the Figures are applicable to this natural escapement mechanism, of which only the general architecture is shown, for the sake of readability of the Figures.

In an advantageous variant, escapement mechanism 10 includes means for taking up play in the direct kinematic connection between first escape wheel set 40A and second escape wheel set 40B, to minimise operating play.

In a particular embodiment, escapement mechanism 10 is incorporated in a movement 100, which includes means for application of a torque to first wheel set 40A, and of a second torque to second wheel set 40B. In particular, the first torque is equal to the second torque.

Figure 30:
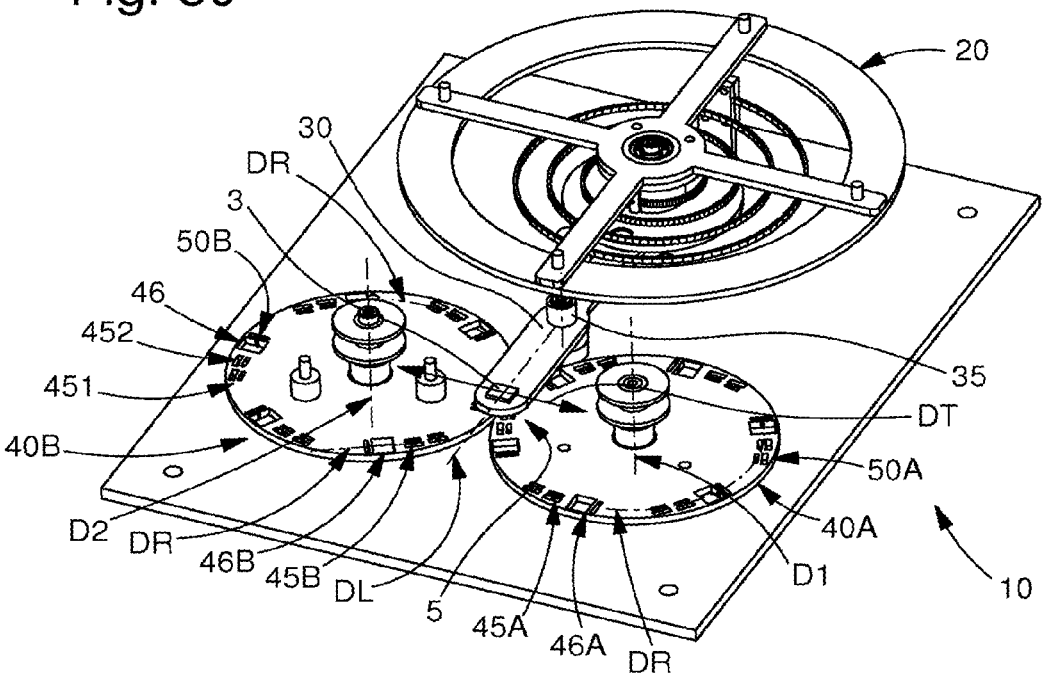

Preferably, and as seen in FIGS. 29 and 30, the first escape wheel set 40A and second escape wheel set 40B pivot about their said respective axes D1, D2, in a synchronous motion and with an opposite pivoting direction.

In an advantageous embodiment facilitating assembly, first escape wheel set 40A and second escape wheel set 40B are spaced from each other, and stop member 30 includes two pole shoes 3 spaced from each other: a first pole shoe 3A arranged to cooperate with first escape wheel set 40A, and a second pole shoe 3B arranged to cooperate with second escape wheel set 40B.

Preferably, escapement mechanism 10 is arranged such that, at every moment, at least one pole shoe 3 of stop member 30 is in interaction with at least one surface 4 of one of escape wheel sets 40A; 40B.

Preferably, barriers 46 comprised in first escape wheel set 40A and second escape wheel set 40B are uniformly distributed therein at the same pitch, and are shifted by a half-step between first escape wheel set 40A and second escape wheel set 40B.

As explained above, preferably, at least on one of escape wheel sets 40A, 40B, or on both, each track 50 includes, before each barrier 46, a ramp 45 extending in a curvilinear ramp direction DR and interacting in an increasing manner, from a ramp bottom 451 towards a ramp top 452 located in proximity to barrier 46, with a pole shoe 3 having a magnetic or respectively electrostatic field, whose intensity varies so as to produce increasing potential energy, ramp 45 taking energy from the escape wheel set concerned 40A, 40B.

Preferably, escape wheel set 40A, 40B includes, between two successive ramps 45, a magnetic, or respectively, electrostatic field potential barrier 46, for triggering a pause of escape wheel set 40A, 40B prior to the tilting of stop member 30 under the periodic action of oscillator 20.

In a particular variant, at least one escape wheel set 40A; 40B (or more particularly both) includes, at the end of each ramp 45 and just before each barrier 46, a radial variation in the magnetic or electrostatic field distribution when surface 4 is magnetized, or respectively, electrically charged, or a profile variation when said surface 4 is ferromagnetic, or respectively, electrostatically conductive, to cause a draw on pole shoe 3, the effect of which is to maintain stop member 30 in one of its stable positions before tilting is triggered.

In particular, resonator 20 comprises a pin, such as an impulse pin or similar, which is arranged to cooperate with a fork or an actuator comprised in stop member 30, in order to cause unlocking (cancelling said draw) followed by a tilt of pole shoe 3 of stop member 30, in a direction tangential to the plane defined by the axes D1, D2 of first escape wheel set 40A and of second escape wheel set 40B, when these axes D1 and D2 are coplanar.

In particular, during such a tilt, pole shoe 3 of stop member 30 is brought from a high ramp level 452 of a first ramp 45 to a low ramp level 451 of a second ramp 45 adjacent to said first ramp, so that pole shoe 3 is subjected to a thrust force of magnetic or respectively electrostatic origin.

In particular, pole shoe 3 of stop member 30 is movable, at first escape wheel set 40A and second escape wheel set 40B between and at an equal distance from two symmetrical surfaces having identical magnetic or respectively electrostatic features to each other.

In particular, at least one escape wheel set 40A, 40B, or both, includes, between two successive ramps 45 of the same track 50 or of two neighbouring tracks 50 in the direction of travel DD, a magnetic, or respectively, electrostatic field potential barrier 46, for triggering a pause of the escape wheel set 40A, 40B concerned, prior to the tilting of stop member 30 under the periodic action of oscillator 20.

Preferably, the potential gradient of each potential barrier 46 is steeper than that of each ramp 45.

In particular, escapement mechanism 10 accumulates potential energy received from said at least one escape wheel set 40A, 40B during each half of period PD, and returns it to resonator 20 between the half-periods during the transverse motion of stop member 30 actuated by the periodic action of resonator 20, wherein pole shoe 3 changes from a first relative transverse half-travel PDC with respect to escape wheel set 40A, 40B to a second relative transverse half-travel DDC with respect to escape wheel set 40A, 40B, or vice versa.

In particular, each of the two opposing components, formed by pole shoe 3 and track 50 bearing the surface 4 that faces the pole shoe over at least part of their relative travel, includes active magnetic, or respectively, electrostatic means, which are arranged to create a magnetic, or respectively, electrostatic field in a direction substantially parallel to axial direction DA, at the interface thereof in air-gap 5 between pole shoe 3 and surface 4 opposite thereto.

In particular, stop member 30 pivots about a real or virtual pivot 35, and comprises a single pole shoe 3 arranged to cooperate with primary areas 44 comprised in said surfaces 4, located on different diameters of escape wheel set 40A, 40B with which pole shoe 3 has a variable interaction during the rotation of escape wheel set 40A, 40B, these primary areas 44 being arranged alternately on the periphery of escape wheel set 40A, 40B, to restrict pole shoe 3 to a radial motion, relative to an axial direction DA which is orthogonal both to a transverse direction DT substantially parallel to the transverse direction TT of pole shoe 3 and to a direction of travel DF of track 50.

In a variant, stop member 30 pivots about a real or virtual pivot 35 and comprises a plurality of pole shoes 3 each arranged to cooperate with primary areas 44 comprised in at least one of surfaces 4 located on a zone of escape wheel set 40A, 40B, with which each pole shoe 3 has a variable interaction during the rotation of escape wheel set 40A, 40B, these primary areas 44 being arranged alternately on the periphery of escape wheel set 40A, 40B, to restrict pole shoe 3 to a radial motion relative to an axial direction DA which is orthogonal both to a transverse direction DT substantially parallel to the transverse direction TT of pole shoe 3 and to a direction of travel DF of track 50.

In a particular variant, the two escape wheel sets 40A, 40B are different in nature, and their interaction with stop member 30 is different in nature. It is also possible to envisage creating a hybrid escapement mechanism with one of the escape wheel sets in magnetic or electrostatic interaction and the other in conventional mechanical interaction.

In particular, at least one escape wheel set 40A, 40B, is an escape wheel 400.

In particular, stop member 30 is a pallet fork.

Figure 31:
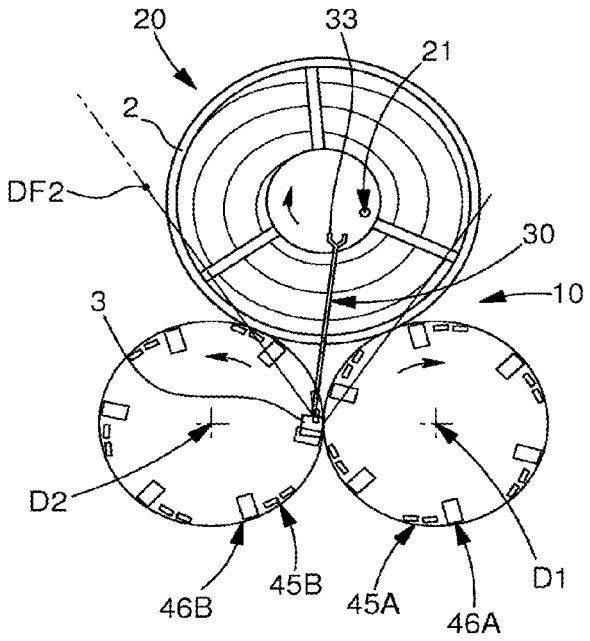
Figure 32:
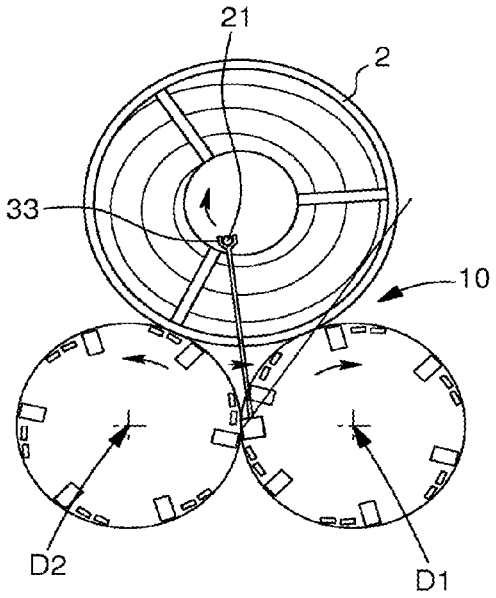
Figure 33:
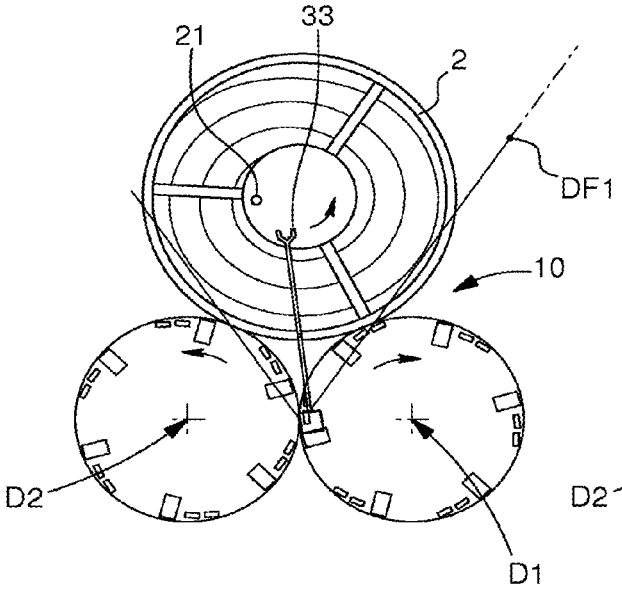
Figure 34:
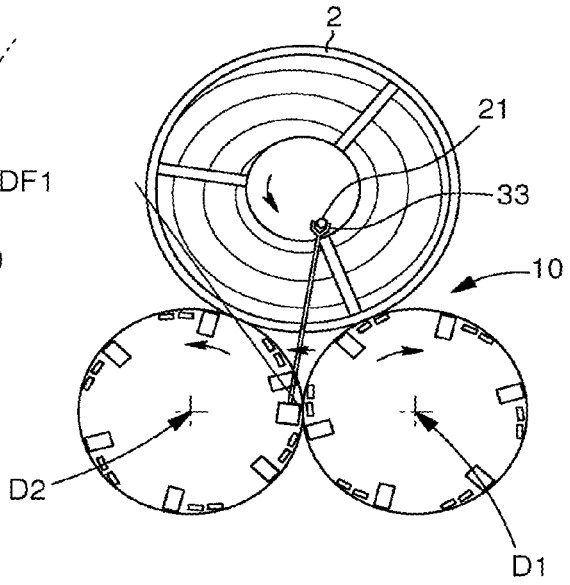

FIGS. 31 to 34 briefly illustrate the kinematics in a magnetic variant:

- In FIG. 31, escape wheel 40B, on the left, rotates until it abuts a potential barrier; pole shoe 3 of stop member 30 formed by a pallet fork, is at the top of a potential ramp;
- In FIG. 32, stop member 30 tilts, unlocking is caused by resonator 20, here a sprung balance, but afterwards it is the magnetic energy that pushes the pallet fork;
- In FIG. 33, escape wheel set 40A, on the right, rotates until it abuts a potential barrier; pole shoe 3 of the pallet fork is at the top of a potential ramp;
- In FIG. 34, stop member 30 tilts the opposite way, unlocking is caused by resonator 20, but afterwards it is the magnetic energy that pushes the pallet fork.

The invention also concerns a timepiece movement 100 including at least one escapement mechanism 10 of this type.

The invention also concerns a timepiece 200 including at least one such movement 100, and/or including at least one such escapement mechanism 10.

To summarise, the magnetic and/or electrostatic interaction potential, composed of alternating ramps with barriers, provides behaviour which is as close as possible to a traditional Swiss lever escapement. Optimizing the shape of the potential gradients makes it possible to increase the efficiency of the escapement.

Replacing the mechanical contact force with a contactless force of magnetic or electrostatic origin according to the invention, therefore procures several advantages, since it is then possible to:

- eliminate friction and thereby reduce wear, and therefore increase operating life,
- increase the efficiency of the escapement, and thereby increase the power reserve,
- design the transition between the potential ramps and barriers to obtain the specific dependence desired between the drive torque and the energy transmitted to the resonator. In particular and in an advantageous manner, it is possible to render the quantity of energy transmitted to the oscillator at each vibration almost constant and independent of the drive torque,
- decouple the tilting of the stop member from the motion of the escape wheel set so that the rapidity of the impulse is not limited by the inertia of the escape wheel set.

What is claimed is:

1. An escapement mechanism for a timepiece comprising:

a stop member between a resonator and a first escape wheel set and a second escape wheel set, each subjected to a torque;

wherein each escape wheel set includes at least one magnetized or ferromagnetic, or respectively, electrically charged or electrostatically conductive track with a period of travel over which the magnetic, or respectively, electrostatic characteristics thereof are repeated, the stop member including at least one magnetized or ferromagnetic, or respectively, electrically charged or electrostatically conductive pole shoe, the pole shoe being movable in a transverse direction relative to a direction of travel of at least one element of a surface of the track, and at least the pole shoe or the track creating a magnetic or electrostatic field in an air-gap between the at least one pole shoe and the at least one surface, wherein the pole shoe is confronted with a magnetic or electrostatic field barrier on the track just before each transverse motion of the stop member actuated by periodic action of the resonator, wherein the first escape wheel set subjected to a first torque and the second escape wheel set subjected to a second torque are each arranged to be configured to cooperate alternately with the stop member, and wherein the first escape wheel set and the second escape wheel set pivot about distinct axes and are connected to each other by a direct kinematic connection.

2. The escapement mechanism according to claim 1, wherein the first torque is equal to the second torque.

3. The escapement mechanism according to claim 1, wherein the first escape wheel set and the second escape wheel set pivot about respective axes thereof, in a synchronous motion and with an opposite pivoting direction.

4. The escapement mechanism according to claim 1, wherein at every moment at least one of the pole shoe of the stop member is in interaction with a surface of one of the first escape wheel set and the second escape wheel set.

5. The escapement mechanism according to claim 1, wherein the barriers comprised in the first escape wheel set and the second escape wheel set are uniformly distributed therein at a same pitch, and are shifted by a half-step between the first escape wheel set and the second escape wheel set.

6. The escapement mechanism according to claim 1, wherein at least on one of the first escape wheel set and the second escape wheel set, the track includes, before each barrier, a ramp extending in a curvilinear ramp direction and interacting in an increasing manner, from a ramp bottom towards a ramp top located in proximity to the barrier, with the pole shoe having a magnetic or respectively electrostatic field, whose intensity varies to produce increasing potential energy, the ramp taking energy from the escape wheel set.

7. The escapement mechanism according to claim 6, wherein on the one first escape wheel set and the second escape wheel set, each the track includes, before each barrier, a ramp extending in a curvilinear ramp direction and interacting in an increasing manner, from a ramp bottom towards a ramp top located in proximity to the barrier, with the pole shoe having a magnetic or respectively electrostatic field, whose intensity varies to produce increasing potential energy, the ramp taking energy from the escape wheel set.

8. The escapement mechanism according to claim 6, wherein the escape wheel set includes, between two of the successive ramps, a magnetic, or respectively, electrostatic field potential barrier, to trigger a pause of the escape wheel set prior to a tilt of the stop member under the periodic action of the resonator.

9. The escapement mechanism according to claim 8, wherein the at least one escape wheel set includes, at the end of each ramp and just before each barrier, a radial variation in the magnetic or electrostatic field distribution when the surface is magnetized, or respectively, electrically charged, or a variation in profile when the surface is ferromagnetic, or respectively, electrostatically conductive, to cause a draw on the pole shoe, an effect of which is to maintain the stop member in one of stable positions thereof before tilting is triggered.

10. The escapement mechanism according to claim 9, wherein the resonator includes a pin configured to cooperate with a fork or an actuator comprised in the stop member, to cause unlocking followed by a tilt of the pole shoe of the stop member, in a tangential direction to a plane defined by the axes of the first escape wheel set and of the second escape wheel set.

11. The escapement mechanism according to claim 10, wherein during a tilt, the pole shoe of the stop member is brought from a high ramp level of a first ramp to a low ramp level of a second ramp adjacent to the first ramp, so that the pole shoe is subjected to a thrust force of magnetic or respectively electrostatic origin.

12. The escapement mechanism according to claim 6, wherein, between two successive ramps of the same track or two neighbouring tracks in a direction of travel, the at least one escape wheel set includes the magnetic, or respectively, electrostatic field potential barrier, for triggering a pause of the escape wheel set prior to a tilt of the stop member under the periodic action of the resonator.

13. The escapement mechanism according to claim 12, wherein potential gradient of each of the potential barrier is steeper than that of the ramp.

14. The escapement mechanism according to claim 1, wherein the pole shoe of the stop member is movable, at the first escape wheel set and the second escape wheel set between and at an equal distance from two symmetrical surfaces having identical magnetic or respectively electrostatic features to each other.

15. The escapement mechanism according to claim 1, wherein the escapement mechanism accumulates potential energy received from at least one of the first escape wheel set and the second escape wheel set during each half of the period, and returns energy to the resonator between half-periods during transverse motion of the stop member actuated by periodic action of the resonator, wherein the pole shoe changes from a first relative transverse half-travel in relation to the escape wheel set to a second relative transverse half-travel in relation to the escape wheel set, or vice versa.

16. The escapement mechanism according to claim 15, wherein each of the two opposing components, formed by the pole shoe and the track bearing the surface that faces the pole shoe over at least part of their relative travel, includes active magnetic, or respectively, electrostatic portion, configured to create a magnetic, or respectively, electrostatic field in a direction substantially parallel to the axial direction, at an interface thereof in the air-gap between the pole shoe and the surface opposite thereto.

17. The escapement mechanism according to claim 1, wherein the stop member pivots about a real or virtual pivot, and comprises a single of the pole shoe configured to cooperate with primary areas comprised in the surfaces, located on different diameters of the at least one escape wheel set with which the pole shoe has a variable interaction during rotation of one of the first escape wheel set and the second escape wheel set, the primary areas being arranged alternately on a periphery of the at least one of the first escape wheel set and the second escape wheel set, to restrict the pole shoe to a radial motion, relative to an axial direction which is orthogonal both to a transverse direction substantially parallel to the transverse direction of the shoe and to a direction of travel of the track.

18. The escapement mechanism according to claim 1, wherein one of the first escape wheel set and the second escape wheel set is an escape wheel.

19. The escapement mechanism according to claim 1, wherein the stop member is a pallet fork.

20. A timepiece movement comprising at least one escapement mechanism according to claim 1.

21. A timepiece comprising at least one movement according to claim 20.

* * * * *